US007688301B2

(12) United States Patent
Lee et al.

(10) Patent No.: US 7,688,301 B2
(45) Date of Patent: Mar. 30, 2010

(54) APPARATUS AND METHOD FOR DRIVING LIQUID CRYSTAL DISPLAY DEVICE

(75) Inventors: Dong Hoon Lee, Seoul (KR); Juhn Suk Yoo, Seoul (KR); Chul Sang Jang, Anyang-si (KR); Oh Kyong Kwon, Seoul (KR)

(73) Assignee: LG Display Co., Ltd., Seoul (KR)

( * ) Notice: Subject to any disclaimer, the term of this patent is extended or adjusted under 35 U.S.C. 154(b) by 1211 days.

(21) Appl. No.: 11/092,945

(22) Filed: Mar. 30, 2005

(65) Prior Publication Data

US 2005/0219190 A1 Oct. 6, 2005

(30) Foreign Application Priority Data

Mar. 30, 2004 (KR) ..... 10-2004-0021748

(51) Int. Cl.
*G09G 3/36* (2006.01)

(52) U.S. Cl. ..... 345/96; 345/98; 345/89; 345/100

(58) Field of Classification Search ..... 345/87–103, 345/204, 211, 691, 1.1, 690, 214; 348/742, 348/743, 791, 273, 276; 257/72; 349/37, 349/40, 123, 97, 149; 313/506; 327/333; 385/4

See application file for complete search history.

(56) References Cited

U.S. PATENT DOCUMENTS 4,317,115 A * 2/1982 Kawakami et al. ..... 345/94
5,089,905 A * 2/1992 Sasaki et al. ..... 349/97
5,739,887 A * 4/1998 Ueda et al. ..... 349/149
5,907,314 A * 5/1999 Negishi et al. ..... 345/103
6,160,535 A * 12/2000 Park ..... 345/88
6,167,169 A * 12/2000 Brinkman et al. ..... 385/4
6,262,704 B1 * 7/2001 Kurumisawa et al. ..... 345/98
6,275,273 B1 * 8/2001 Inoue ..... 349/40
6,559,595 B1 * 5/2003 Inoue ..... 313/506
6,727,968 B1 * 4/2004 Bryan-Brown et al. ..... 349/123
6,831,633 B1 * 12/2004 Murade ..... 345/204
6,919,752 B2 * 7/2005 Lim ..... 327/333
6,963,328 B2 * 11/2005 Kang et al. ..... 345/100
7,023,419 B2 * 4/2006 Park ..... 345/103
7,042,527 B2 * 5/2006 Imai ..... 348/742
7,133,035 B2 * 11/2006 Kim et al. ..... 345/204
7,205,972 B1 * 4/2007 Kyeong et al. ..... 345/98
7,259,755 B1 * 8/2007 Ahn ..... 345/204
7,342,566 B2 * 3/2008 Ha et al. ..... 345/100
7,403,185 B2 * 7/2008 Song et al. ..... 345/100

(Continued)

*Primary Examiner*—Prabodh M Dharia
(74) *Attorney, Agent, or Firm*—McKenna Long & Aldridge LLP

(57) ABSTRACT

A driving apparatus of a liquid crystal display device according to an embodiment of the present invention includes a liquid crystal display panel having a liquid crystal cell of a matrix shape to display a video signal; N (where N is a positive integer) number of data drive circuits that generate a polarity pattern of the video signal and supply it to the liquid crystal cell through a plurality of output channels; and a polarity controller that controls the polarity signal and supplies it to the N number of the data drive circuits on the basis of a first selection signal corresponding to the number of the output channels and a second selection signal corresponding to a repetition period of the polarity pattern.

9 Claims, 14 Drawing Sheets

U.S. PATENT DOCUMENTS

2001/0002829 A1* 6/2001 Nishimura ..... 345/96
2001/0043178 A1* 11/2001 Okuzono et al. ..... 345/87
2002/0005843 A1* 1/2002 Kurumisawa et al. ..... 345/204
2002/0024618 A1* 2/2002 Imai ..... 348/743
2002/0060656 A1* 5/2002 Okuzono ..... 345/88
2003/0090450 A1* 5/2003 Inada et al. ..... 345/87
2004/0085280 A1* 5/2004 Kim ..... 345/97
2004/0100318 A1* 5/2004 Lim ..... 327/333
2004/0104880 A1* 6/2004 Kang et al. ..... 345/94
2004/0207538 A1* 10/2004 Wei et al. ..... 340/853.3
2004/0263466 A1* 12/2004 Song et al. ..... 345/100
2007/0030236 A1* 2/2007 Kim et al. ..... 345/98
2007/0069214 A1* 3/2007 Lee ..... 257/72
2007/0109288 A1* 5/2007 Kida ..... 345/211
2008/0129904 A1* 6/2008 Kang et al. ..... 349/37

* cited by examiner

| Dot | Chsel | POL | |
|---|---|---|---|
| | | Odd Data D-IC | Eevn Data D-IC |
| L | L | POL | POL |
| L | H | POL | POL |
| H | L | POL | IPOL |
| H | H | POL | POL |

Dot = "L" → ONE-DOT INVERSION
Dot = "H" → TWO-DOT INVERSION
Chsel = "L" → 414 OUTPUT CHANNELS
Chsel = "H" → 384 OUTPUT CHANNELS

APPARATUS AND METHOD FOR DRIVING LIQUID CRYSTAL DISPLAY DEVICE

This application claims the benefit of Korean Patent Application No. P2004-21748 filed in Korea on Mar. 30, 2004, which is hereby incorporated by reference for all purposes as if fully set forth herein.

BACKGROUND OF THE INVENTION

1. Field of the Invention

The present invention relates to a liquid crystal display device, and more particularly to a driving apparatus and method of a liquid crystal display device that is adaptive for preventing a picture quality defect caused by non-uniformity of a sub-pixel signal polarity in accordance with the number of output channels of a data drive circuit.

2. Description of the Related Art

Generally, a liquid crystal display device controls the light transmissivity of liquid crystal using an electric field, to display a picture. For this, the liquid crystal display device includes a liquid crystal display panel where liquid crystal cells are arranged in a matrix shape and a drive circuit to drive the liquid crystal display panel.

In fact, the liquid crystal display device, as illustrated in FIG. 1, includes a liquid crystal display panel 6 that displays a picture in accordance with the polarity pattern of a sub-pixel signal; a data TCP (Tape Carrier Package) 8 on which a data D-IC (Drive Integrated Circuit) 10 is mounted for driving data lines of the liquid crystal display panel 6; a gate TCP 4 on which a gate D-IC 12 is mounted for driving gate lines of the liquid crystal display panel 6; and a timing controller 30 to drive the data IC's 10 and the gate D-IC's 12.

The liquid crystal display panel 6 includes a liquid crystal layer formed between an upper substrate 5 and a lower substrate 3, and a spacer to maintain a distance between the upper substrate 5 and the lower substrate 3. A color filter, a common electrode, a black matrix and so on are formed in the upper substrate 5 of the liquid crystal display panel 6. The common electrode may be formed in the lower substrate 3 in accordance with a liquid crystal layer mode of the liquid crystal display panel 6. Further, the lower substrate 3 of the liquid crystal display panel 6 includes a thin film transistor formed at each crossing of the gate lines and the data lines, and a liquid crystal cell connected to the thin film transistor. A gate electrode of the thin film transistor is connected to any one of the gate lines (the horizontal lines), and a source electrode is connected to any one of the data lines (the vertical lines). The thin film transistor supplies a pixel signal from the data line to the liquid crystal cell in response to a scan signal from the gate line. The liquid crystal cell includes a pixel electrode connected to a drain electrode of the thin film transistor, and a common electrode facing the pixel electrode with a liquid crystal layer therebetween. The liquid crystal cell drives the liquid crystal layer in response to the pixel signal supplied to the pixel electrode, thereby controlling the light transmissivity.

In order to drive the liquid crystal cells on the liquid crystal display panel 6, an inversion driving method is used such as a frame inversion system, a line inversion system and a dot inversion system. In the driving method of the frame inversion system, the polarity of the pixel signals supplied to the liquid crystal cells on the liquid crystal display panel 6 is inverted whenever a frame is changed. In the driving method of the line inversion system, the polarity of the pixel signals supplied to the liquid crystal cells is inverted in accordance with the line (column) on the liquid crystal display panel 6.

The dot inversion system has a pixel voltage signal supplied of which a polarity is contrary to the polarity of the pixel signals supplied to the liquid crystal cells that are adjacent to the liquid crystal cells on the liquid crystal display panel 6 in their vertical and horizontal directions, and the polarity of the pixel signals supplied to all the liquid crystal cells on the liquid crystal display panel 6 is inverted every frame. The drive of such an inversion method is performed by having the data D-IC's 10 respond according to a polarity signal POL supplied to each of the data D-IC's 10 from the timing controller 30.

The liquid crystal display device of the related art is driven by a frame frequency of 60 Hz. But, in a low power-consumption system like a notebook, the frame frequency is lower, between 50 Hz to 30 Hz. As the frame frequency decreases, a greenish phenomenon is produced even in the dot inversion system which provides the best picture quality. Thus, a horizontal 2-dot inversion system and a square inversion system have been suggested.

In the horizontal 2-dot inversion system, the polarity of the sub-pixel signal is changed on a per-dot basis in a vertical direction, but is changed each two dots in a horizontal direction. In addition, the polarity of the pixel signals supplied to all the liquid crystal cells on the liquid crystal display panel 6 is inverted every frame. In the square inversion system, the polarity of the sub-pixel signal is changed by the two dots in both a vertical direction and a horizontal direction. In addition, the polarity of the pixel signals supplied to all the liquid crystal cells on the liquid crystal display panel 6 is inverted every frame.

In this way, in the one dot inversion system, the polarity of the sub-pixel signal supplied to the liquid crystal cell repeats by two liquid crystal cells in the horizontal direction. On the other hand, in the two dot inversion system, the polarity of the sub-pixel signal supplied to the liquid crystal cell repeats by four liquid crystal cells in the horizontal direction, and in the square inversion system, the polarity of the sub-pixel signal supplied to the liquid crystal cell repeats by four liquid crystal cells in the vertical and horizontal directions.

The timing controller 30 generates gate control signals such as GSP, GSC, GOE and so on that control the drive of the gate D-IC's 4, and generates data control signals such as SSP, SSC, SOE, POL and so on that control the drive of the data IC's 10. Further, the timing controller 30 aligns the data signal supplied from the system to fit the data signal for the drive of the liquid crystal display panel 6, and supplies the aligned data signal to a plurality of data D-IC's 10.

The timing controller 30 is mounted on a data PCB (printed circuit board) 20. The data PCB 20 is connected to an external system through a user connector. On the data PCB 20, there are various signal lines that supply various control signals and data signals from the timing controller 30 to each of the data D-IC's 10 and the gate D-IC's 12.

Each of the gate D-IC's 12 is mounted on the gate TCP 4. The gate D-IC 12 mounted on the gate TCP 4 is electrically connected to the gate pads of the liquid crystal display panel 6 through the gate TCP 4. The gate D-IC's 12 sequentially drive the gate lines of the liquid crystal display panel 6 by the one horizontal period (1H). The gate TCP 4 is connected to a gate PCB 26. The gate PCB 26 supplies the gate control signals supplied from the timing controller 30 through the data PCB 20 to the gate D-IC's 12 through the gate TCP 4.

Each of the data D-IC's 10 is mounted on each of the data TCP 8. The data D-IC 10 mounted on the data TCP 8 is electrically connected to the data pads of the liquid crystal display panel 6 through the data TCP 8. The data D-IC's 10 convert a digital pixel data into an analog pixel signal to supply the converted pixel signal to the data lines of the liquid crystal display panel 6 by the one horizontal period (1H).

In this way, in the driving device of the related art liquid crystal display device, the repetition period of the sub-pixel signal polarity becomes uniform or non-uniform in accordance with the number of the output channels of the data D-IC 10 and the inversion method of the polarity pattern of the sub-pixel signal supplied to the liquid crystal display panel 6.

For example, the data D-IC 10 having even-numbered output channels might produce output such that the polarity of the sub-pixel signal has the polarity pattern of the one dot inversion system regardless of the number of output channels of the data D-IC. 10. In other words, as illustrated in FIG. 2, if the pixel signal having the polarity pattern of the one dot inversion system is supplied to the liquid crystal display panel 6 using the data D-IC's 10 having 384 (a multiple of 4) output channels (Ch1 to Ch384), the polarity of the sub-pixel signal between the last output channel Ch384 of the odd-numbered data D-IC 10 and the first output channel Ch1 of the even-numbered data D-IC 10 is not equal but inverted. That is, the polarity of the sub-pixel signal outputted from the last output channel Ch384 of the odd-numbered data D-IC 10 is "–", and the polarity of the sub-pixel signal outputted from the first output channel Ch1 of the even-numbered data D-IC 10 is "+".

In addition, if the pixel signal having the polarity pattern of the one dot inversion system is supplied to the liquid crystal display panel 6 using the data D-IC's 10 having 414 (which is not a multiple of 4, but is a multiple of 2) output channels (Ch1 to Ch414), the polarity of the sub-pixel signal between the last output channel Ch414 of the odd-numbered data D-IC 10 and the first output channel Ch1 of the even-numbered data D-IC 10 is not equal but inverted. Accordingly, the driving method of the liquid crystal display panel 6 by the one dot inversion system using the data D-IC 10 having a number of output channels that is a multiple of 2, is driven to have the polarity pattern of the exact one dot inversion system regardless of the number of output channels of the data D-IC 10.

On the other hand, as illustrated in FIG. 3, if the pixel signal having the polarity pattern of the horizontal two dot inversion system is supplied to the liquid crystal display panel 6 using the data D-IC's 10 having 384 (a multiple of 4) output channels (Ch1 to Ch384), the polarity of the sub-pixel signal between the last two output channels Ch 383, Ch384 of the odd-numbered data D-IC 10 and the first and second output channels Ch1, Ch2 of the even-numbered data D-IC 10 is not equal but inverted. In other words, the polarity of the sub-pixel signal outputted from the last two output channels Ch383, Ch384. of the odd-numbered data D-IC 10 is "––", and the polarity of the sub-pixel signal outputted from the first and second output channels Ch1, Ch2 of the even-numbered data D-IC 10 is "++". Accordingly, the driving method of the liquid crystal display panel 6 by the two dot inversion system using the data D-IC 10 having a number of output channels that is a multiple of 4, is driven to have the polarity pattern of the exact horizontal two dot inversion system regardless of the number of output channels of the data D-IC 10.

Furthermore, as illustrated in FIG. 4, if the pixel signal having the polarity pattern of the horizontal two dot inversion system is supplied to the liquid crystal display panel 6 using the data D-IC's 10 having 414 (not a multiple of 4, but a multiple of 2) output channels (Ch1 to Ch414), the polarity of the sub-pixel signal between the last two output channels Ch 413, Ch414 of the odd-numbered data D-IC 10 and the first and second output channels Ch1, Ch2 of the even-numbered data D-IC 10 is equal.

For example, if the polarity of the sub-pixel signal outputted from the first and second output channels Ch1, Ch2 of the data D-IC 10 having a number of output channels that is a multiple of 2, starts with "++", the polarity of the sub-pixel signal outputted from the first and second output channels Ch1, Ch2 of each of the odd-numbered data D-IC 10 and the even-numbered data D-IC 10 starts with "++". Because of this, the polarity of the sub-pixel signal outputted from the last two output channels Ch413, Ch414 of the odd-numbered data D-IC 10 is "++", and the polarity of the sub-pixel signal outputted from the first and second output channels Ch1, Ch2 of the even-numbered data D-IC 10 is "++". Accordingly, in driving the liquid crystal display panel 6 by the two dot inversion system using the data D-IC 10 having a number of output channels that is a multiple of 2, the same polarity of the sub-pixel signal is supplied to the four liquid crystal cells which are a bordering area between the adjacent data D-IC's 10.

Therefore, as illustrated in FIG. 4, if the number of the output channels of the data D-IC 10 is not a multiple of 4, the repetition period of the sub-pixel signal polarity is non-uniform at a bordering area A between the adjacent data D-IC's 10 to generate a picture quality defect such as a vertical line in the driving apparatus of the liquid crystal display device using the related art horizontal two dot inversion system.

On the other hand, as illustrated in FIG. 5, if the pixel signal having the polarity pattern of the square inversion system using the data D-IC's 10 having 414 (not a multiple of 4, but a multiple of 2) output channels Ch1 to Ch414, the polarity of the sub-pixel signal between the last two output channels Ch 413, Ch414 of the odd-numbered data D-IC 10 and the first and second output channels Ch1, Ch2 of the even-numbered data D-IC 10 of the $j^{th}$ (where j is a positive integer) and $(j+1)^{th}$ horizontal lines is equal. For example, if the polarity of the sub-pixel signal outputted from the first and second output channels Ch1, Ch2 of the data D-IC 10 having a number of output channels that is a multiple of 2, starts with "++", the polarity of the sub-pixel signal outputted from the first and second output channels Ch1, Ch2 of each of the odd-numbered data D-IC 10 and the even-numbered data D-IC 10 of each of the $j^{th}$ and $(j+1)^{th}$ horizontal lines starts with "++". Because of this, the polarity of the sub-pixel signal outputted from the last two output channels Ch413, Ch414 of the odd-numbered data D-IC 10 of each of the $j^{th}$ and $(j+1)^{th}$ horizontal lines is "++", and the polarity of the sub-pixel signal outputted from the first and second output channels Ch1, Ch2 of the even-numbered data D-IC 10 of each of the $j^{th}$ and $(j+1)^{th}$ horizontal lines is "++". Accordingly, in driving the liquid crystal display panel 6 by the square inversion system using the data D-IC 10 having a number of output channels that is a multiple of 2, the same polarity of the sub-pixel signal is supplied to the eight liquid crystal cells which are a bordering area between the adjacent data D-IC's 10.

Therefore, as illustrated in FIG. 5, if the number of the output channels of the data D-IC 10 is not a multiple of 4, the repetition period of the sub-pixel signal polarity is non-uniform at a bordering area A between the adjacent data D-IC's 10 to generate a picture quality defect such as a vertical line in the driving, apparatus of the liquid crystal display device using the related art square inversion system.

SUMMARY OF THE INVENTION

Accordingly, it is an advantage of the present invention to provide a driving apparatus and method of a liquid crystal display device that is adaptive for preventing a picture quality defect caused by non-uniformity of a sub-pixel signal polarity in accordance with the number of output channels of a data drive circuit.

It is another advantage of the present invention to provide a driving apparatus and method of a liquid crystal display device that is adaptive for making the repetition period of pixel polarity and the number of output channels uniform regardless of the number of output channels of a data drive circuit.

In order to achieve these and other advantages of the present invention, a driving apparatus of a liquid crystal display device according to an aspect of the present invention includes a liquid crystal display panel having a liquid crystal cell of a matrix shape to display a video signal; N (where N is a positive integer) numbers of data drive circuits that generate a polarity pattern of the video signal and supply it to the liquid crystal cell through a plurality of output channels; and a polarity controller that controls the polarity signal and supplies it to the N number of the data drive circuits on the basis of a first selection signal corresponding to the number of the output channels and a second selection signal corresponding to a repetition period of the polarity pattern.

The driving apparatus further includes a timing controller that supplies the video signal to the N number of the data drive circuits and generates the polarity signal; and a printed circuit board on which the timing controller is mounted.

In the driving apparatus, the polarity pattern is in accordance with a horizontal two-dot inversion system where it is alternated by the two liquid crystal cells in a horizontal direction of the liquid crystal display panel, and by the one liquid crystal cell in a vertical direction of the liquid crystal display panel.

In the driving apparatus, the polarity pattern is in accordance with a square inversion system where it is alternated by the two liquid crystal cells in horizontal and vertical directions of the liquid crystal display panel.

In the driving apparatus, the polarity controller includes: a first input terminal that receives the first selection signal of a first logic state corresponding to the number of the a number of output channels that is a multiple of 2; a second input terminal that receives the second selection signal of the first logic state corresponding to any one system of the two-dot inversion system and the square inversion system; and a third input terminal to which the polarity signal is supplied.

In the driving apparatus, the polarity controller is mounted on the printed circuit board.

In the driving apparatus, the polarity controller is built in any one among the N number of the data drive circuits.

In the driving apparatus, the polarity controller outputs a polarity signal from the timing controller through a first output terminal and inverts the polarity signal to output it through a second output terminal in response to a first selection signal of the first logic state and a second selection signal of the first logic state.

In the driving apparatus, the polarity controller outputs the polarity signal from the timing controller through each of first and second output terminals in response to each of the first and second selection signals of a logic state other than the first selection signal and the second selection signal of the first logic state.

In the driving apparatus, the first output terminal is connected to each of the odd-numbered data drive circuits, and the second output terminal is connected to each of the even-numbered data drive circuits.

In the driving apparatus, the polarity controller is built in each of the N number of the data drive circuits.

In the driving apparatus, a first polarity controller built in a first data drive circuit in the polarity controller built in each of the N number of the data drive circuits receives the polarity signal from the timing controller, and the polarity controller built in the rest data drive circuits, i.e., second to $N^{th}$ data drive circuits, receives the polarity signal from the polarity controller built in the previous stage data drive circuit.

In the driving apparatus, the first polarity controller outputs a polarity signal from the timing controller through a first output terminal and inverts the polarity signal to output it through a second output terminal in response to a first selection signal of the first logic state and a second selection signal of the first logic state, and each of the polarity controllers built in the second to $N^{th}$ data drive circuits outputs the polarity signal supplied from a second output terminal of the polarity controller built in the previous stage data drive circuit through the first output terminal and inverts the polarity signal to output it through the second output terminal in response to a first selection signal of the first logic state and a second selection signal of the first logic state.

In the driving apparatus, the first polarity controller outputs a polarity signal from the timing controller through each of first and second output terminals in response to each of first and second selection signals of a logic state other than a first selection signal of the first logic state and a second selection signal of the first logic state, and each of the polarity controllers built in the second to $N^{th}$ data drive circuits outputs the polarity signal supplied from a second output terminal of the polarity controller built in the previous stage data drive circuit through the first and second output terminals in response to each of first and second selection signals of a logic state other than a first selection signal of the first logic state and a second selection signal of the first logic state.

In the driving apparatus, each of the N number of the data drive circuits generates a polarity pattern of the video signal from the timing controller in accordance with the polarity signal outputted from a first output terminal of the polarity controller, which is built-in.

A driving apparatus of a liquid crystal display device according to another aspect of the present invention includes a liquid crystal display panel having a liquid crystal cell of a matrix shape to display a video signal; N number of data drive circuits that generate a polarity pattern of the video signal and supply it to the liquid crystal cell through a plurality of output channels; and a polarity controller that supplies the polarity signal contrary to each other to the adjacent data drive circuit in accordance with the number of the output channels.

The driving apparatus further includes a timing controller that supplies the video signal to the N number of the data drive circuits and generates the polarity signal; and a printed circuit board on which the timing controller is mounted.

In the driving apparatus, the polarity pattern is in accordance with a horizontal two-dot inversion system where it is alternated by the two liquid crystal cells in a horizontal direction of the liquid crystal display panel, and by the one liquid crystal cell in a vertical direction of the liquid crystal display panel.

In the driving apparatus, the polarity pattern is in accordance with a square inversion system where it is alternated by the two liquid crystal cells in horizontal and vertical directions of the liquid crystal display panel.

In the driving apparatus, the polarity controller includes: a first input terminal that receives a first selection signal of a first logic state corresponding to the number of the a number of output channels that is a multiple of 2; a second input terminal that receives a second selection signal of the first logic state corresponding to any one system of the two-dot inversion system and the square inversion system; and a third input terminal to which the polarity signal is supplied.

In the driving apparatus, the polarity controller controls the polarity signal and supplies it to the N number of the data drive circuits through first and second output terminals on the basis of the first and second selection signals.

In the driving apparatus, the polarity controller is mounted on the printed circuit board.

In the driving apparatus, the polarity controller is built in any one among the N number of the data drive circuits.

In the driving apparatus, the polarity controller outputs the polarity signal from the timing controller through the first output terminal and inverts the polarity signal to output it through the second output terminal in response to a first selection signal of the first logic state and a second selection signal of the first logic state.

In the driving apparatus, the polarity controller outputs the polarity signal from the timing controller through each of the first and second output terminals in response to each of the first and second selection signals of a logic state other than a first selection signal of the first logic state and a second selection signal of the first logic state.

In the driving apparatus, the first output terminal is connected to each of the odd-numbered data drive circuits, and the second output terminal is connected to each of the even-numbered data drive circuits.

In the driving apparatus, the polarity controller is built in each of the N number of the data drive circuits.

In the driving apparatus, a first polarity controller built in a first data drive circuit in the polarity controller built in each of the N number of the data drive circuits receives the polarity signal from the timing controller, and the polarity controller built in the rest data drive circuits, i.e., second to $N^{th}$ data drive circuits, receives the polarity signal from the polarity controller built in the previous stage data drive circuit.

In the driving apparatus, the first polarity controller outputs a polarity signal from the timing controller through a first output terminal and inverts the polarity signal to output it through a second output terminal in response to a first selection signal of the first logic state and a second selection signal of the first logic state, and each of the polarity controllers built in the second to $N^{th}$ data drive circuits outputs the polarity signal supplied from a second output terminal of the polarity controller built in the previous stage data drive circuit through the first output terminal and inverts the polarity signal to output it through the second output terminal in response to a first selection signal of the first logic state and a second selection signal of the first logic state.

In the driving apparatus, the first polarity controller outputs a polarity signal from the timing controller through each of first and second output terminals in response to each of first and second selection signals of a logic state other than a first selection signal of the first logic state and a second selection signal of the first logic state, and each of the polarity controllers built in the second to $N^{th}$ data drive circuits outputs the polarity signal supplied from a second output terminal of the polarity controller built in the previous stage data drive circuit through each of the first and second output terminals in response to each of first and second selection signals of a logic state other than a first selection signal of the first logic state and a second selection signal of the first logic state.

In the driving apparatus, each of the N number of the data drive circuits controls a polarity pattern of the video signal in accordance with the polarity signal outputted from a first output terminal of the polarity controller, which is built-in.

A driving method of a liquid crystal display device having a liquid crystal display panel which includes a liquid crystal cell of a matrix shape to display a video signal, and a plurality of data drive circuits that generates a polarity pattern of the video signal to supply it to the liquid crystal cell through a plurality of output channels, according to still another aspect of the present invention includes: generating a polarity signal; controlling the polarity signal in accordance with the number of the output channels using a polarity controller; and generating a polarity pattern of the video signal to supply it to the liquid crystal display panel in accordance with the polarity signal supplied from the polarity controlled.

The driving method further includes: generating a first selection signal corresponding to the number of the output channels; and generating a second selection signal corresponding to a repetition period of the polarity pattern.

In the driving method, the polarity pattern is in accordance with a horizontal two-dot inversion system where it is alternated by the two liquid crystal cells in a horizontal direction of the liquid crystal display panel, and by the one liquid crystal cell in a vertical direction of the liquid crystal display panel.

In the driving method, the polarity pattern is in accordance with a square inversion system where it is alternated by the two liquid crystal cells in horizontal and vertical directions of the liquid crystal display panel.

In the driving method, the step of generating the first selection signal includes: generating the first selection signal of a first logic state corresponding to the number of the a number of output channels that is a multiple of 2; and generating the first selection signal of a second logic state, which is in inversion of a first logic state, corresponding to the number of the a number of output channels that is a multiple of 4.

In the driving method, the step of generating the second selection signal includes: generating the second selection signal of a first logic state corresponding to any one system of the two-dot inversion system and the square inversion system; and generating the second selection signal of a second logic state corresponding to an inversion system other than any one system of the two-dot inversion system and the square inversion system.

In the driving method, the polarity controller outputs the polarity signal to a first output terminal and inverts the polarity signal to output it to a second output terminal in response to a first selection signal of the first logic state and a second selection signal of the first logic state.

In the driving method, the polarity controller outputs the polarity signal to each of the first and second output terminals in response to first and second selection signals of a logic state other than a first selection signal of the first logic state and a second selection signal of the first logic state.

In the driving method, the polarity signal outputted from a first output terminal of the polarity controller is supplied to each of the odd-numbered data drive circuits, and the polarity signal outputted from a first output terminal of the polarity controller is supplied to each of the even-numbered data drive circuits.

In the driving method, the polarity controller is built in each of the data drive circuits, and a first polarity controller built in the first data drive circuit receives the polarity signal from the outside, and each of the polarity controllers built in the rest data drive circuits, i.e., second to Nth data drive circuits, receives the polarity signal outputted from the polarity controller built in the previous stage data drive circuit.

In the driving method, the first polarity controller outputs the polarity signal supplied from the outside to a first output terminal and inverts the polarity signal to output it to a second output terminal in response to a first selection signal of the first logic state and a second selection signal of the first logic state, and each of the second to $N^{th}$ polarity controllers outputs the polarity signal, which is supplied from the second output terminal of the polarity controller built in the previous stage data drive circuit, to the first output terminal and inverts the polarity signal to output it through the second output terminal.

In the driving method, the first polarity controller outputs the polarity signal supplied from the outside through each of the first and second output terminals in response to first and second selection signals of a logic state other than a first selection signal of the first logic state and a second selection signal of the first logic state, and each of the second to $N^{th}$ polarity controllers outputs the polarity signal, which is supplied from the second output terminal of the polarity controller built in the previous stage data drive circuit, through each of the first and second output terminals in response to first and second selection signals of a logic state other than a first selection signal of the first logic state and a second selection signal of the first logic state.

In the driving method, the data drive circuits control a polarity pattern of the video signal in accordance with the polarity signal supplied from the first output terminal of the polarity controller.

A driving method of a liquid crystal display device having a liquid crystal display panel which includes a liquid crystal cell of a matrix shape to display a video signal, and a plurality of data drive circuits that generates a polarity pattern of the video signal to supply it to the liquid crystal cell through a plurality of output channels, according to still another aspect of the present invention includes: a first step of generating a polarity signal; and a second step of supplying the polarity signal contrary to each other to the adjacent data drive circuits to control a polarity pattern of the video signal in accordance with the number of the output channels.

The driving method further includes: generating a first selection signal corresponding to the number of the output channels; and generating a second selection signal corresponding to a repetition period of the polarity pattern.

In the driving method, the polarity pattern is in accordance with a horizontal two-dot inversion system where it is alternated by the two liquid crystal cells in a horizontal direction of the liquid crystal display panel, and by the one liquid crystal cell in a vertical direction of the liquid crystal display panel.

In the driving method, the polarity pattern is in accordance with a square inversion system where it is alternated by the two liquid crystal cells in horizontal and vertical directions of the liquid crystal display panel.

In the driving method, the step of generating the first selection signal includes: generating the first selection signal of a first logic state corresponding to the number of the a number of output channels that is a multiple of 2; and generating the first selection signal of a second logic state, which is in inversion of a first logic state, corresponding to the number of the a number of output channels that is a multiple of 4.

In the driving method, the step of generating the second selection signal includes: generating the second selection signal of a first logic state corresponding to any one system of the two-dot inversion system and the square inversion system; and generating the second selection signal of a second logic state corresponding to an inversion system other than any one system of the two-dot inversion system and the square inversion system.

In the driving method, the second step includes the step of: controlling the polarity signal in accordance with the first selection signal and the second selection signal using a polarity controller.

In the driving method, the polarity controller outputs the polarity signal to a first output terminal and inverts the polarity signal to output it to a second output terminal in response to a first selection signal of the first logic state and a second selection signal of the first logic state.

In the driving method, the polarity controller outputs the polarity signal to a first output terminal and inverts the polarity signal to output it to a second output terminal in response to a first selection signal of the first logic state and a second selection signal of the first logic state.

In the driving method, the polarity controller outputs the polarity signal to each of the first and second output terminals in response to first and second selection signals of a logic state other than a first selection signal of the first logic state and a second selection signal of the first logic state.

In the driving method, the polarity signal outputted from a first output terminal of the polarity controller is supplied to each of the odd-numbered data drive circuits, and the polarity signal outputted from a first output terminal of the polarity controller is supplied to each of the even-numbered data drive circuits.

In the driving method, the polarity controller is built in each of the data drive circuits, and a first polarity controller built in the first data drive circuit receives the polarity signal from the outside, and each of the polarity controllers built in the rest data drive circuits, i.e., second to Nth data drive circuits, receives the polarity signal outputted from the polarity controller built in the previous stage data drive circuit.

In the driving method, the first polarity controller outputs the polarity signal supplied from the outside to a first output terminal and inverts the polarity signal to output it to a second output terminal in response to a first selection signal of the first logic state and a second selection signal of the first logic state, and each of the second to $N^{th}$ polarity controllers outputs the polarity signal, which is supplied from the second output terminal of the polarity controller built in the previous stage data drive circuit, to the first output terminal and inverts the polarity signal to output it through the second output terminal.

In the driving method, the first polarity controller outputs the polarity signal supplied from the outside through each of the first and second output terminals in response to first and second selection signals of a logic state other than a first selection signal of the first logic state and a second selection signal of the first logic state, and each of the second to $N^{th}$ polarity controllers outputs the polarity signal, which is supplied from the second output terminal of the polarity controller built in the previous stage data drive circuit, through each of the first and second output terminals in response to first and second selection signals of a logic state other than a first selection signal of the first logic state and a second selection signal of the first logic state.

In the driving method, the data drive circuits controls a polarity pattern of the video signal in accordance with the polarity signal supplied from the first output terminal of the polarity controller.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE ILLUSTRATED EMBODIMENTS

Reference will now be made in detail to embodiments of the present invention, examples of which are illustrated in the accompanying drawings.

Hereinafter, the exemplary embodiments of the present invention will be described in detail with reference to FIGS. 6 to 17.

Figure 1:
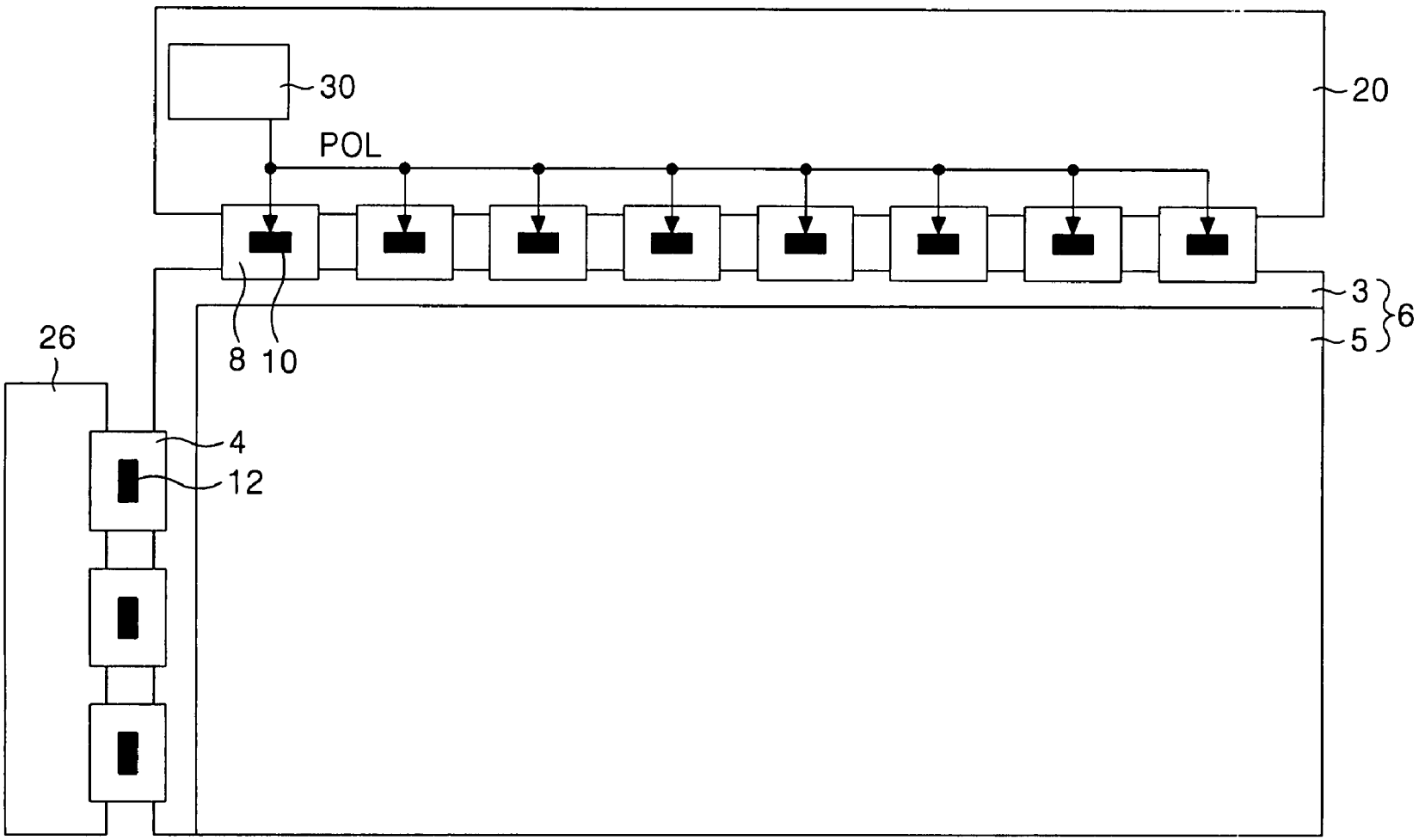
FIG. 1 RELATED ART
FIG. 1 is a diagram illustrating a driving apparatus of a related art liquid crystal display device.
Figure 2:
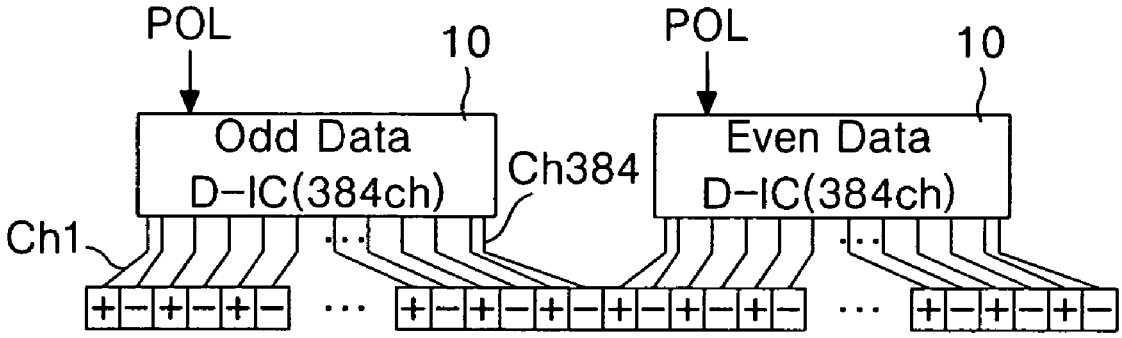
FIG. 2 RELATED ART
FIG. 2 is a diagram illustrating a polarity pattern of a one-dot inversion system outputted between adjacent data D-IC's having a number of output channels that is a multiple of 4, illustrated in FIG. 1.
Figure 3:
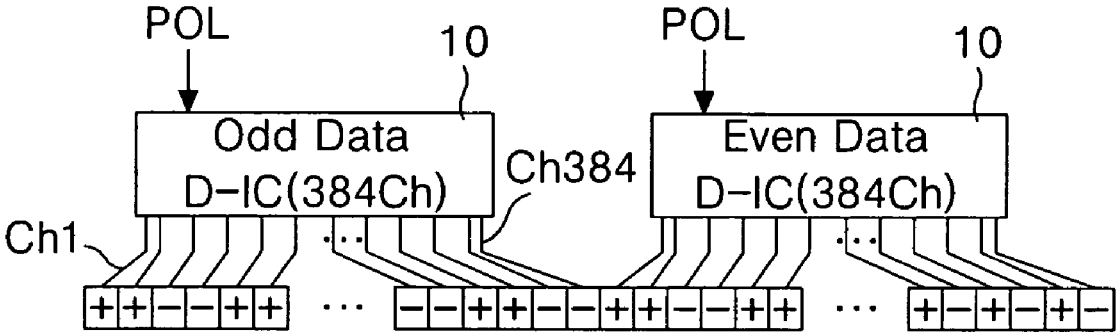
FIG. 3 RELATED ART
FIG. 3 is a diagram illustrating a polarity pattern of a two-dot inversion system outputted between adjacent data D-IC's having a number of output channels that is a multiple of 4, illustrated in FIG. 1.
Figure 4:
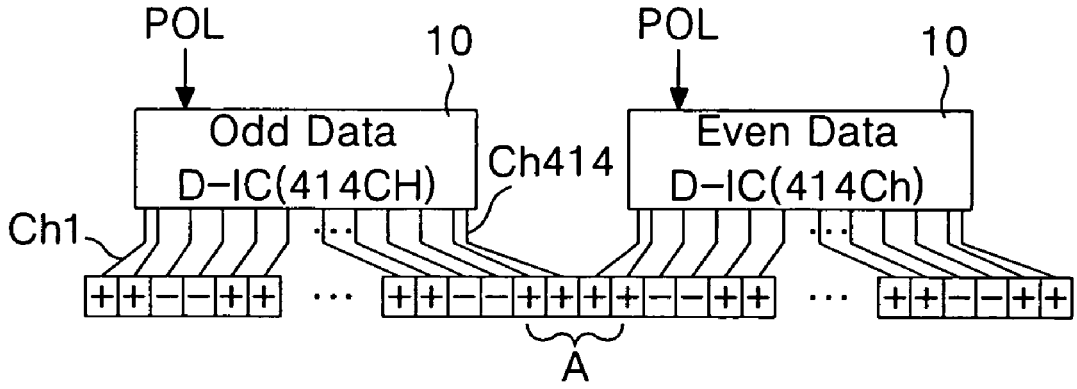
FIG. 4 RELATED ART
FIG. 4 is a diagram illustrating a polarity pattern of a two-dot inversion system outputted between adjacent data D-IC's having a number of output channels that is a multiple of 2, illustrated in FIG. 1.
Figure 5:
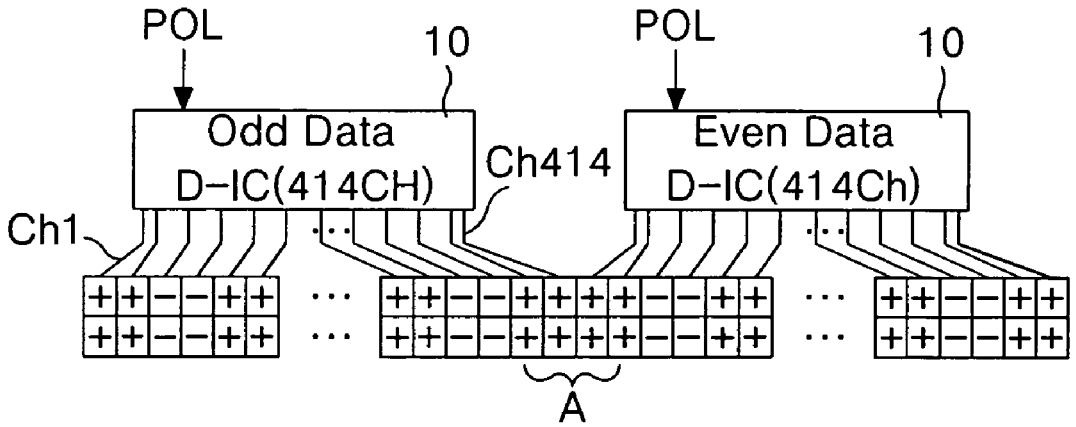
FIG. 5 RELATED ART
FIG. 5 is a diagram illustrating a polarity pattern of a square inversion system outputted between adjacent data D-IC's having a number of output channels that is a multiple of 2, illustrated in FIG. 1.
Figure 6:
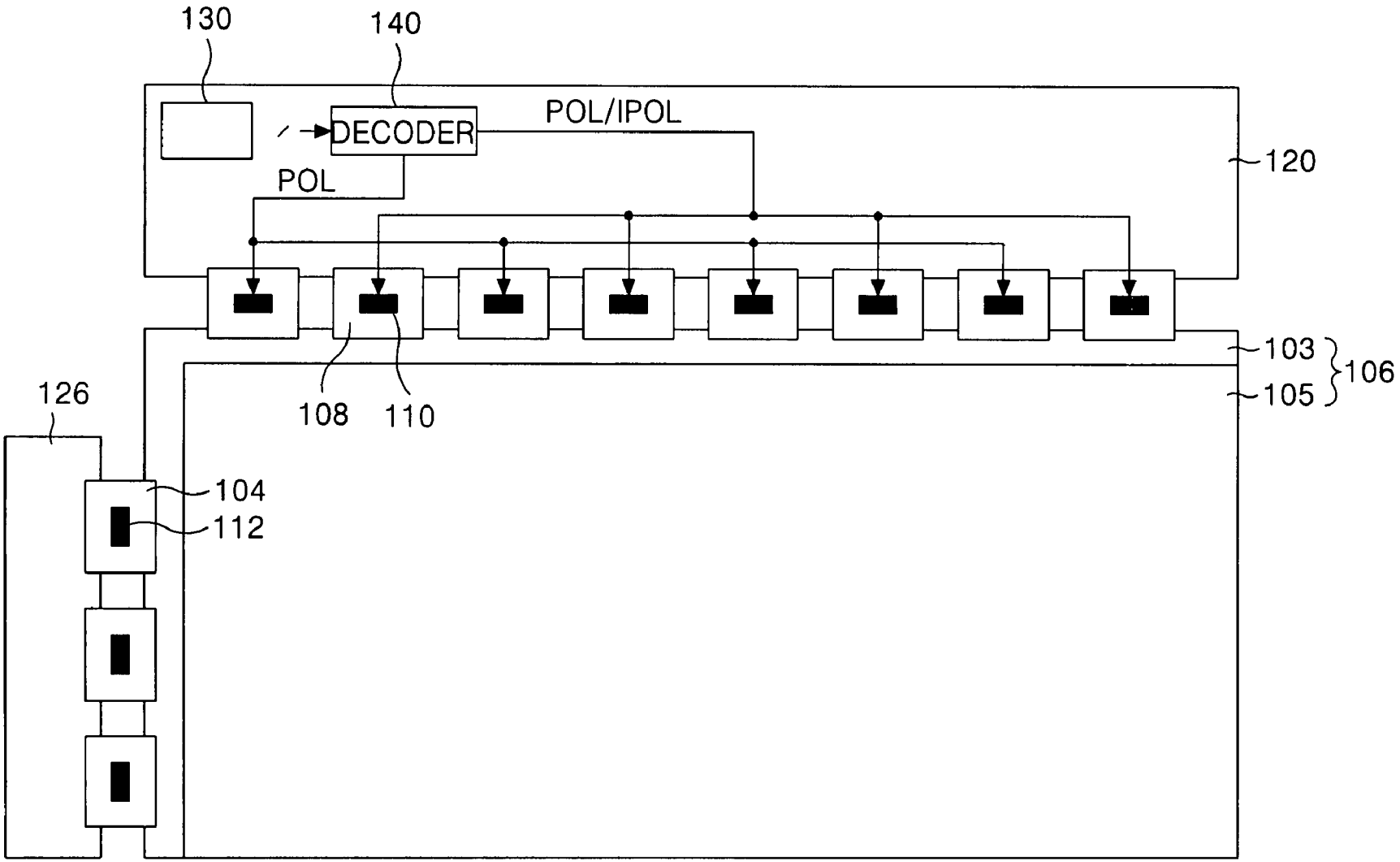
FIG. 6 is a diagram illustrating a driving apparatus of a liquid crystal display device according to a first embodiment of the present invention.

Referring to FIG. 6, a driving apparatus of a liquid crystal display device according to a first embodiment of the present invention includes a liquid crystal display panel 106 to display a picture in accordance with the polarity pattern of a sub-pixel signal; a plurality of data tape carrier packages (hereinafter, referred to as "TCP") on which a data drive integrated circuit (hereinafter, referred to as "D-IC") for driving data lines of the liquid crystal display panel 106 is mounted; a plurality of gate TCP's on which a gate D-IC for driving gate lines of the liquid crystal display panel 106; a timing controller 130 to control the drive of the data D-IC's 110 and the gate D-IC's 112; and a decoder 140 to change a polarity signal POL supplied from the timing controller 130 on the basis of the polarity pattern of the sub-pixel signal displayed in the liquid crystal display panel 6 and the number of output channels of the data D-IC 110.

The liquid crystal display panel 106 includes a liquid crystal layer formed between an upper substrate 105 and a lower substrate 103 and a spacer to maintain the distance between the upper substrate 105 and the lower substrate 103. A color filter, a common electrode, a black matrix and so on are formed in the upper substrate 105 of the liquid crystal display panel 106. A common electrode may be formed in the lower substrate 103 in accordance with a liquid crystal layer mode of the liquid crystal display panel 106. Further, the lower substrate 103 of the liquid crystal display panel 106 includes a thin film transistor formed at every intersection of the gate lines and the data lines, and a liquid crystal cell connected to the thin film transistor. A gate electrode of the thin film transistor is connected to any one among the gate lines of horizontal line, and a source electrode is connected to any one of the data lines of vertical line. The thin film transistor responds to a scan signal from the gate line to supply a pixel signal from the data line to the liquid crystal cell. The liquid crystal cell includes a pixel electrode connected to a drain electrode of the thin film transistor and a common electrode facing the pixel electrode with the liquid crystal layer therebetween. The liquid crystal cell responds to the pixel signal supplied to the pixel electrode to drive the liquid crystal layer, thereby controlling its light transmissivity.

In order to drive the liquid crystal cells on the liquid crystal display panel 106, an inversion driving method is used such as a frame inversion system, a line inversion system and a dot inversion system. The driving method of the frame inversion system makes the polarity of the pixel signals supplied to the liquid crystal cells on the liquid crystal display panel 106 inverted whenever a frame is changed. The driving method of the line inversion system makes the polarity of the pixel signals supplied to the liquid crystal cells inverted in accordance with the line (column) on the liquid crystal display panel 106. The dot inversion system makes the pixel voltage signal supplied, wherein the polarity of the pixel voltage signal is contrary to the polarity of the pixel signals supplied to the liquid crystal cells each adjacent in vertical and horizontal directions to the liquid crystal cells of the liquid crystal display panel 106, and in addition, it makes the polarity of the pixel signals supplied to all the liquid crystal cells on the liquid crystal display panel 106 every frame. The dot inversion system among the inversion driving methods provides a picture of better quality than the frame and line inversion systems.

In the related art, a liquid crystal display device is driven by a frame frequency of 60 Hz. However, the frame frequency is lowered to between 50 Hz and 30 Hz in a system such as a notebook, where low power consumption is needed. As the frame frequency gets decreases, a greenish phenomenon is generated even in the dot inversion system which provides the best picture quality.

In the horizontal two dot inversion system, it is driven so that the polarity of the sub-pixel signal is changed by the dot in a vertical direction while being changed by the two dots in a horizontal direction, and in addition, the polarity of the pixel signals supplied to all the liquid crystal cells on the liquid crystal display panel 106 is inverted every frame. In the square inversion system, it is driven so that the polarity of the sub-pixel signal is changed by two dots in a vertical direction and also changed by two dots in a horizontal direction, and in addition, the polarity of the pixel signals supplied to all the liquid crystal cells on the liquid crystal display panel 106 is inverted every frame.

In this way, in the one-dot inversion system, the polarity of the sub-pixel signal supplied to the liquid crystal cell repeats by two liquid crystal cells in the horizontal direction. But on the other hand, in the horizontal two-dot inversion system, the polarity of the sub-pixel signal supplied to the liquid crystal cell repeats by four liquid crystal cells in the horizontal direction, and in the square inversion system, the polarity of the sub-pixel signal supplied to the liquid crystal cell repeats by four liquid crystal cells in the horizontal and vertical directions.

The timing controller 130 generates gate control signals such as GSP, GSC, GOE and so on, which control the gate D-IC's 104, and data control signals such as SSP, SSC, SOE, POL and so on, which control the data D-IC's 110. Further, the timing controller 130 aligns the data signal supplied from a system for the drive of the liquid crystal display panel 106, and supplies the aligned data signal to a plurality of data D-IC's 110.

The timing controller 130 is mounted on the data printed circuit board (hereinafter, referred to as "PCB") 120. The data PCB 120 is connected to an external system through a user connector. On the data PCB 120, there are formed various signal lines for supplying various control signals and data signals from the timing controller 130 to each of the data D-IC's 110 and the gate D-IC's 112.

Each of the gate D-IC's 112 is mounted on a gate TCP 104, respectively. The gate D-IC 112 mounted on the gate TCP 104 is electrically connected to gate pads of the liquid crystal display panel 106 through the gate TCP 104. The gate D-IC's 112 sequentially drive the gate lines of the liquid crystal display panel 106 by the one horizontal period (1H). The gate TCP 104 is connected to the gate PCB 126. The gate PCB 126 supplies the gate control signals supplied from the timing controller 130 through the data PCB 120 to the gate D-IC's 112 through the gate TCP 104.

Figures 7, 8:
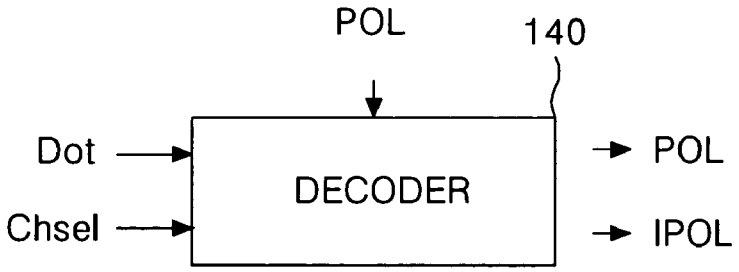
FIG. 7 is a diagram illustrating a decoder illustrated in FIG. 6.
FIG. 8 is a table representing a polarity signal outputted in accordance with an input signal inputted to the decoder illustrated in FIG. 7.

The decoder 140, as illustrated in FIG. 7, outputs the polarity signal POL, which is supplied from the timing controller 130, as it is or by having it inverted on the basis of the number of output channels of the data D-IC's 110 and the polarity pattern Dot of the inputted sub-pixel signal and supplies it to each of the data D-IC's 110.

For this, the decoder 140 includes a polarity signal input terminal to which the polarity signal POL is supplied from the timing controller 130; a polarity pattern input terminal to which a first selection signal Dot of high state or low state is inputted in accordance with the inversion method of the liquid crystal display panel 106; a channel selection input terminal to which a second selection signal Chsel corresponding to the number of output channels of the data D-IC's 110 is inputted; a first output terminal to output the polarity signal POL from the polarity signal input terminal in response to the first selection signal Dot and the second selection signal Chsel; and a second output terminal to invert and output the polarity signal POL from the polarity signal input terminal in response to the first: selection signal Dot and the second selection signal Chsel.

Each of the first and second selection signals Dot, Chsel is set by a system engineer and supplied through the data PCB 120.

The first output terminal of the decoder 140 is connected to odd-numbered data D-IC's 110 among a plurality of data D-IC's 110, and the second output terminal is connected to even-numbered data D-IC's 110 among the data D-IC's 110.

The first selection signal Dot, as illustrated in FIG. 8, becomes a low state if the driving method of the liquid crystal display panel 106 is the one-dot inversion system, and high state if the horizontal two-dot or square inversion system. The second selection signal Chsel becomes low state if the number of output channels of the data D-IC's 110 is a multiple of 2, and high state if a multiple of 4.

Accordingly, the decoder 140 supplies the polarity signal POL from the polarity signal input terminal to the odd-numbered data D-IC's 110 connected to the first output terminal and inverts the polarity signal POL to supply the inverted polarity signal to the even-numbered data D-IC's 110 connected to the second output terminal in the first selection signal Dot of high state inputted to the polarity pattern input terminal and the second selection signal Chsel of low state inputted to the channel selection input terminal. But on the other hand, the decoder 140 supplies the polarity signal POL from the polarity signal input terminal to each of the data D-IC's 110 through each of the first output terminal and the second output terminal except for the inputted first selection signal Dot of high state and second selection signal Chsel of low state.

In this way, the decoder 140 converts the polarity signal POL inputted from the timing controller 130 in accordance with the first selection signal Dot and the second selection signal Chsel to supply to each of the odd-numbered data D-IC's 110 and the even-numbered D-IC's 110. As a result, the decoder 140 matches the number of output channels of the data D-IC 110 with the polarity repetition period of the sub-pixel signal, which is inverted by the inversion driving method of the liquid crystal display panel 106. Accordingly, the decoder 140 inverts the polarity signal POL supplied to the adjacent data D-IC's 110 to control the polarity of the liquid crystal cell of a bordering area of the odd-numbered data D-IC's 110 and the even-numbered D-IC's 110, thereby preventing a picture quality defect.

Each of the data D-IC's 110 is mounted on a data TCP 108, respectively. The data D-IC 110 mounted on the data TCP 108 is electrically connected to data pads of the liquid crystal display panel 106 through the data TCP 108. The data D-IC's 110 converts a digital pixel data into an analog pixel signal to supply the converted pixel signal to the data lines of the liquid crystal display panel 106 by the one horizontal period (1H).

Figure 9:
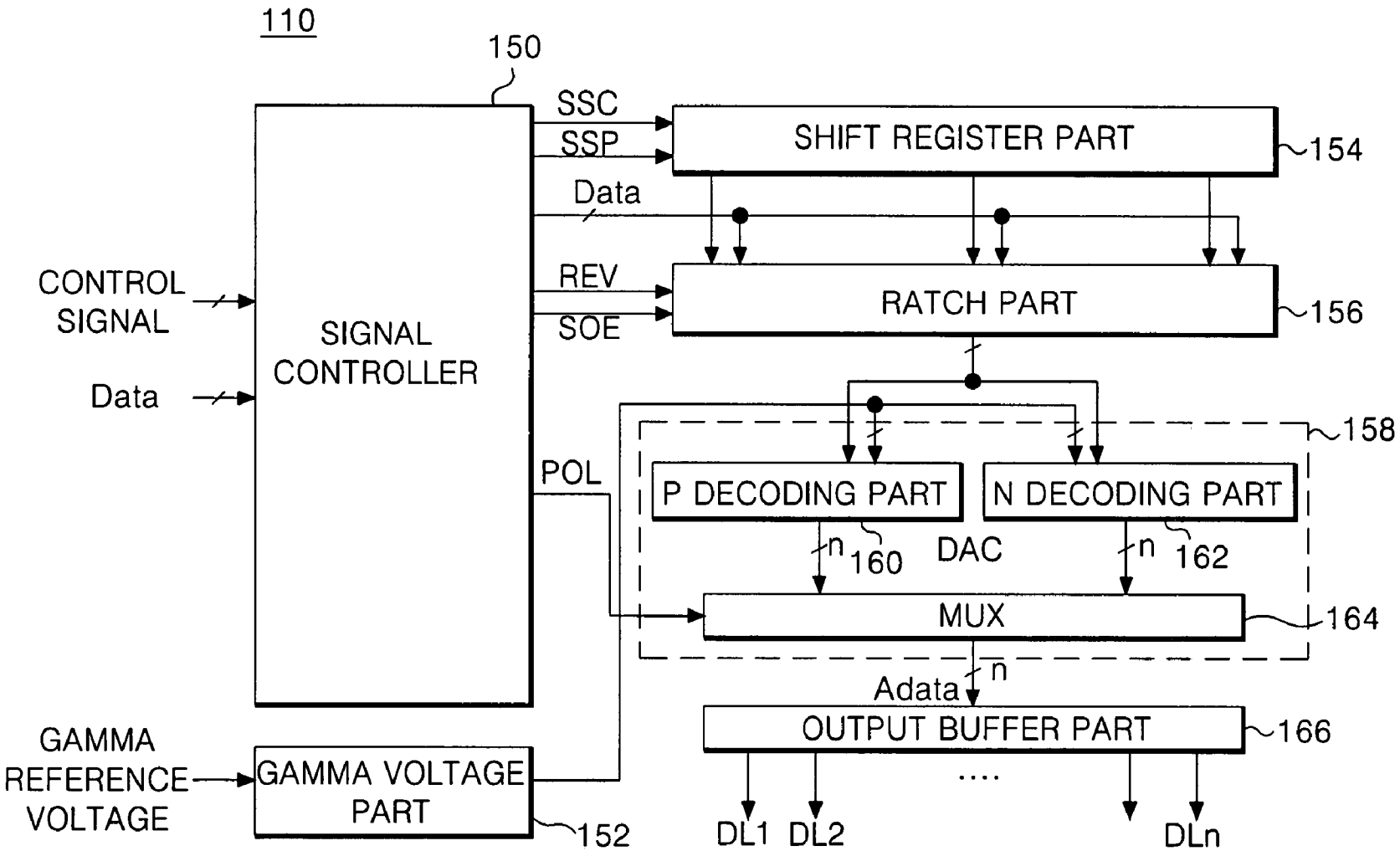
FIG. 9 is a block diagram illustrating a data D-IC (drive integrated circuit) illustrated in FIG. 6.

For this, each of the data D-IC's 110, as illustrated in FIG. 9, includes a shift register part 154 to sequentially supply a sampling signal; a latch part 156 to sequentially latch the digital data Data in response to the sampling signal and at the same time to output the latched digital data; a digital-analog converter (hereinafter, referred to as "DAC") 158 to convert the digital data Data from the latch part 156 into a pixel signal AData; and an output buffer part 166 to buff the pixel signal AData from the DAC 158 and output it.

Further, each of the data D-IC's 110 further includes a signal controller 150 to relay the digital data Data and data control signals SSP, SSC, SOE, REV, POL supplied from the timing controller 130; and a gamma voltage part 152 to supply positive and negative gamma voltages which are needed in the DAC 158. Each of the data D-IC's 110 with such a composition drives N number of data lines DL1 to DLn.

The signal controller 150 controls so that digital data Data, the polarity signal POL converted at and supplied from the decoder 140 and the various data control signals such as SSP, SSC, SOE, REV and so on from the timing controller 130 are outputted to their corresponding components.

The gamma voltage part 152 subdivides a plurality of reference gamma voltages inputted from a reference gamma voltage generator (not illustrated) by grays and outputs them.

N number of shift registers included in the shift register part 154 sequentially shift the source start pulse SSP from the signal controller 150 in accordance with the source sampling clock signal SSC and output it as a sampling signal.

The latch part 156 sequentially samples the digital data Data from the signal controller 150 by fixed units and latches it in response to the sampling signal from the shift register part 154. For this, the latch part 156 is composed of N number of latches to latch N number of digital data Data, and each of the latches has the size corresponding to the bit number (3 bit or 6 bit) of the digital data. For example, the timing controller 130 divides the digital data Data into an even data and an odd data and simultaneously outputs them through each transmission line in order to reduce a transmission frequency. Herein, each of the even data and the odd data includes red R, green G and blue B data. Accordingly, the latch part 156 simultaneously latches the even data and the odd data, i.e., 6 digital data, supplied through the signal controller 150 every sampling signal. Subsequently, the latch part 156 simultaneously outputs the N number of data Data, which are latched in response to the source output enable signal SOE from the signal controller 150. In this case, the latch part 156 restores the digital data Data, which are modulated for the number of transition bits to be reduced, to output them in response to a data inversion selection signal REV. This is because the digital data Data, where the number of bits transited to minimize electromagnetic interference EMI when transmitting data in the timing controller 130 is over a standard value, is modulated to have the number of transition bits reduced, thereby being supplied.

The DAC 158 converts the digital data Data from the latch part 156 into the positive and negative pixel signal AData at the same time. For this, the DAC 158 includes a P (positive) decoding part 160 and an N (negative) decoding part 162 commonly connected to the latch part 156, and a multiplexer MUX part 164 to select the output signal of the P decoding part 160 and the N decoding part 162.

N number of P decoders included in the P decoding part 160 convert N number of data Data simultaneously inputted from the latch part 156 into the positive pixel signal AData using the positive gamma voltages from the gamma voltage part 152. N number of N decoders included in the N decoding part 162 convert N number of data Data simultaneously inputted from the latch part 156 into the negative pixel signal AData using the negative gamma voltages from the gamma voltage part 152. N number of multiplexers included in the multiplexer part 164 selects the positive pixel signal AData from the P decoder 160 or the negative pixel signal AData from the N decoder 162 to output it in response to the polarity signal POL from the decoder 140 through the signal controller 150.

N number of output buffers included in the output buffer part 166 are composed of a voltage follower each connected to the N number of data lines D1 to Dn. The output buffers buff the pixel signal AData from the DAC 158 to supply the buffed pixel signal to the data lines DL1 to DLn.

In this way, the driving apparatus of the liquid crystal display device according to the first embodiment of the present invention converts the digital data Data outputted from the timing controller 130 into the pixel signal AData, which has a polarity pattern by the inversion method, using the DAC 158 of the data D-IC 110 to which the positive and negative gamma voltages are supplied from the gamma voltage part 152, and supplies the converted pixel signal AData to the liquid crystal display panel 106, thereby displaying a desired picture in the liquid crystal display panel 106.

The driving apparatus and method of the liquid crystal display device according to the first embodiment of the present invention inverts the polarity signal POL supplied between the adjacent data D-IC's 110 for the repetition period of the polarity pattern of the sub-pixel signal to be matched with the number of output channels of the data D-IC 110 using the decoder 140, thereby preventing a picture quality defect at the bordering area between the adjacent data D-IC's 110.

For example, if the liquid crystal display panel 106 is driven by the one-dot inversion system using the data D-IC 110 having a number of output channels that is a multiple of 2, as illustrated in FIG. 8, the decoder 140 supplies the polarity signal POL supplied from the timing controller 130 to the odd-numbered data D-IC 110 and to the even-numbered data D-IC 110 at the same time. Accordingly, the driving apparatus and method of the liquid crystal display device according to the first embodiment of the present invention inverts the polarity of the sub-pixel signal, which is supplied to the liquid crystal display panel 106 from the bordering area of the adjacent data D-IC's 110, i.e., each of the last output channel of the odd-numbered data D-IC 110 and the first output channel of the even-numbered data D-IC 110.

Accordingly, the driving apparatus and method of the liquid crystal display device according to the first embodiment of the present invention, in which the liquid crystal display panel 106 is driven by the one-dot inversion system using the data D-IC 110 having a number of output channels that is a multiple of 2, has the repetition period of the polarity pattern of the sub-pixel signal uniform by the dot, wherein the repetition period is in accordance with the number of the output channels of the data D-IC 110, thereby preventing the picture quality defect caused by the non-uniformity of the polarity pattern of the sub-pixel signal.

Further, if the liquid crystal display panel 106 is driven by the one-dot inversion system using the data D-IC 110 having a number of output channels that is a multiple of 4, as illustrated in FIG. 8, the decoder 140 supplies the polarity signal POL supplied from the timing controller 130 to the odd-numbered data D-IC 110 and the even-numbered data D-IC 110. Accordingly, the driving apparatus and method of the liquid crystal display device according to the first embodiment of the present invention inverts the polarity of the sub-pixel signal, which is supplied to the liquid crystal display panel 106 from the bordering area of the adjacent data D-IC's 110, i.e., each of the last output channel of the odd-numbered data D-IC 110 and the first output channel of the even-numbered data D-IC 110.

Accordingly, the driving apparatus and method of the liquid crystal display device according to the first embodiment of the present invention, in which the liquid crystal display panel 106 is driven by the one-dot inversion system using the data D-IC 110 having a number of output channels that is a multiple of 4, has the repetition period of the polarity pattern of the sub-pixel signal uniform by the dot, wherein the repetition period is in accordance with the number of the output channels of the data D-IC 110, thereby preventing the picture quality defect caused by the non-uniformity of the polarity pattern of the sub-pixel signal.

Figure 10:
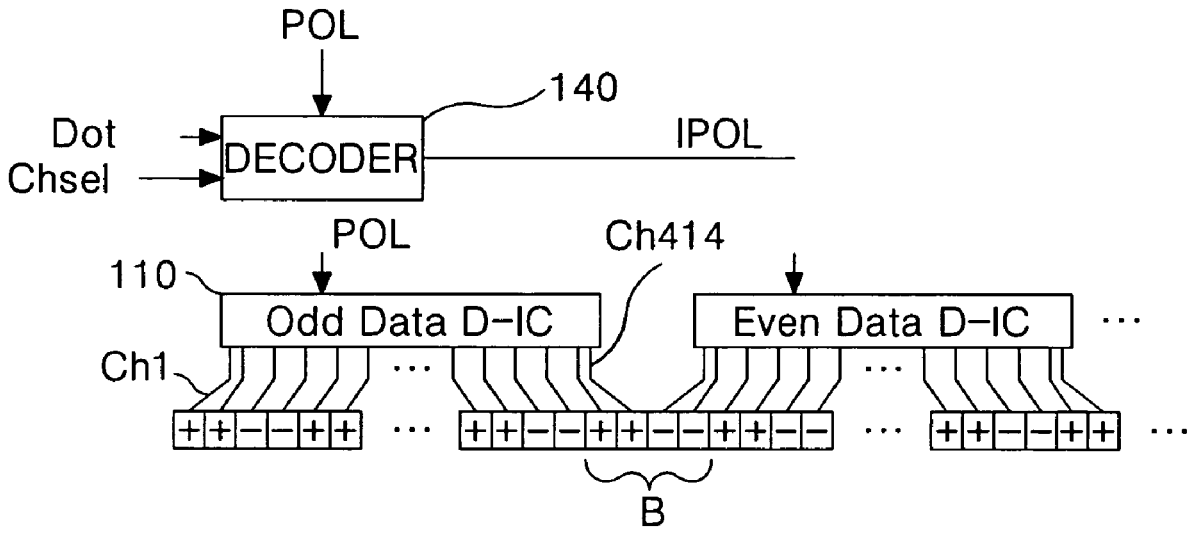
FIG. 10 is a diagram illustrating a polarity pattern of a two-dot inversion system outputted between adjacent D-IC's having a number of output channels that is a multiple of 2, illustrated in FIG. 6.

On the other hand, if the liquid crystal display panel 106 is driven by the horizontal two-dot inversion system using the data D-IC 110 having a number of output channels that is a multiple of 2, as illustrated in FIG. 8, the decoder 140 supplies the polarity signal POL supplied from the timing controller 130 to the odd-numbered data D-IC 110 and the inverted polarity signal IPOL, which was made by inverting the polarity signal POL supplied from the timing controller 130, to the even-numbered data D-IC 110. Accordingly, the driving apparatus and method of the liquid crystal display device according to the first embodiment of the present invention has the polarity of the sub-pixel signal inverted, wherein the sub-pixel signal is supplied to the liquid crystal display panel 106 from the bordering area B between the adjacent data D-IC's 110, i.e., each of the last output channel of the odd-numbered data D-IC 110 and the first output channel of the even-numbered data D-IC 110, as illustrated in FIG. 10. In other words, in driving the data D-IC 110 having a number of output channels that is a multiple of 2, by the horizontal two-dot inversion system, the inverted polarity signal IPOL outputted from the decoder 140 is supplied to the even-numbered data D-IC 110, thereby inverting the polarity signals POL, IPOL supplied to the odd-numbered data D-IC 110 and the even-numbered data D-IC 110.

Accordingly, the driving apparatus and method of the liquid crystal display device according to the first embodiment of the present invention, in which the liquid crystal display panel 106 is driven by the horizontal two-dot inversion system using the data D-IC 110 having a number of output channels that is a multiple of 2, has the repetition period of the polarity pattern of the sub-pixel signal uniform by the horizontal two dots, wherein the repetition period is in accordance with the number of the output channels of the data D-IC 110, thereby preventing the picture quality defect caused by the non-uniformity of the polarity pattern of the sub-pixel signal.

Figure 11:
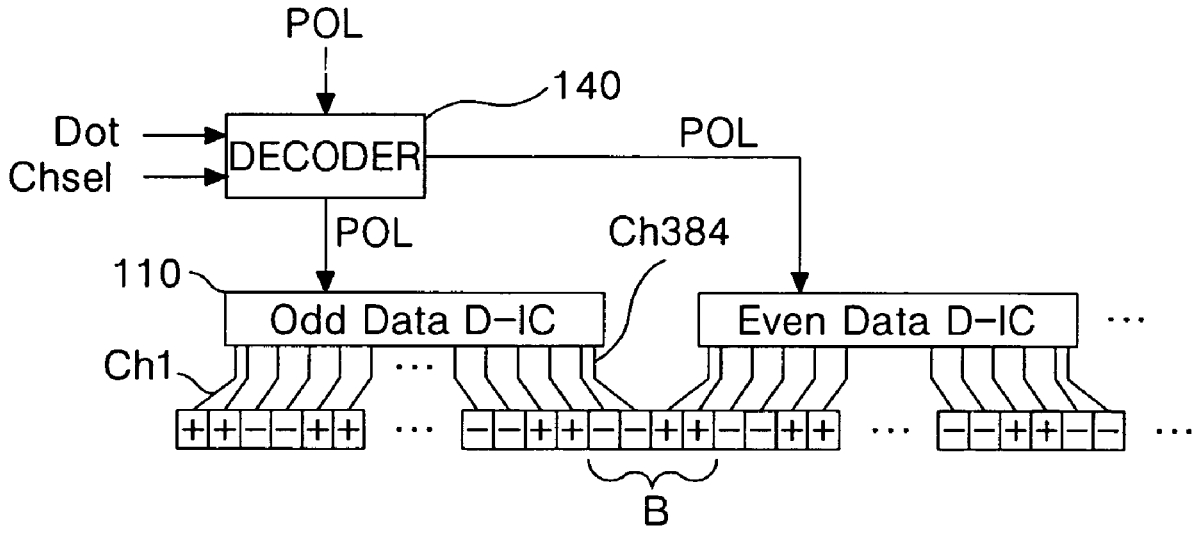
FIG. 11 is a diagram illustrating a polarity pattern of a two-dot inversion system outputted between adjacent D-IC's having a number of output channels that is a multiple of 4, illustrated in FIG. 6.

On the other hand, if the liquid crystal display panel 106 is driven by the horizontal two-dot inversion system using the data D-IC 110 having a number of output channels that is a multiple of 4, as illustrated in FIG. 8, the decoder 140 supplies the polarity signal POL supplied from the timing controller 130 to the odd-numbered data D-IC 110 and the even-numbered data D-IC 110. Accordingly, the driving apparatus and method of the liquid crystal display device according to the first embodiment of the present invention inverts the polarity of the sub-pixel signal, which is supplied to the liquid crystal display panel 106 from the bordering area B of the adjacent data D-IC's 110, i.e., each of the last output channel of the odd-numbered data D-IC 110 and the first output channel of the even-numbered data D-IC 110, as illustrated in FIG. 11.

Accordingly, the driving apparatus and method of the liquid crystal display device according to the first embodiment of the present invention, in which the liquid crystal display panel 106 is driven by the horizontal two-dot inversion system using the data D-IC 110 having a number of output channels that is a multiple of 4, has the repetition period of the polarity pattern of the sub-pixel signal uniform by the horizontal two dots, wherein the repetition period is in accordance with the number of the output channels of the data D-IC 110, thereby preventing the picture quality defect caused by the non-uniformity of the polarity pattern of the sub-pixel signal.

Figure 12:
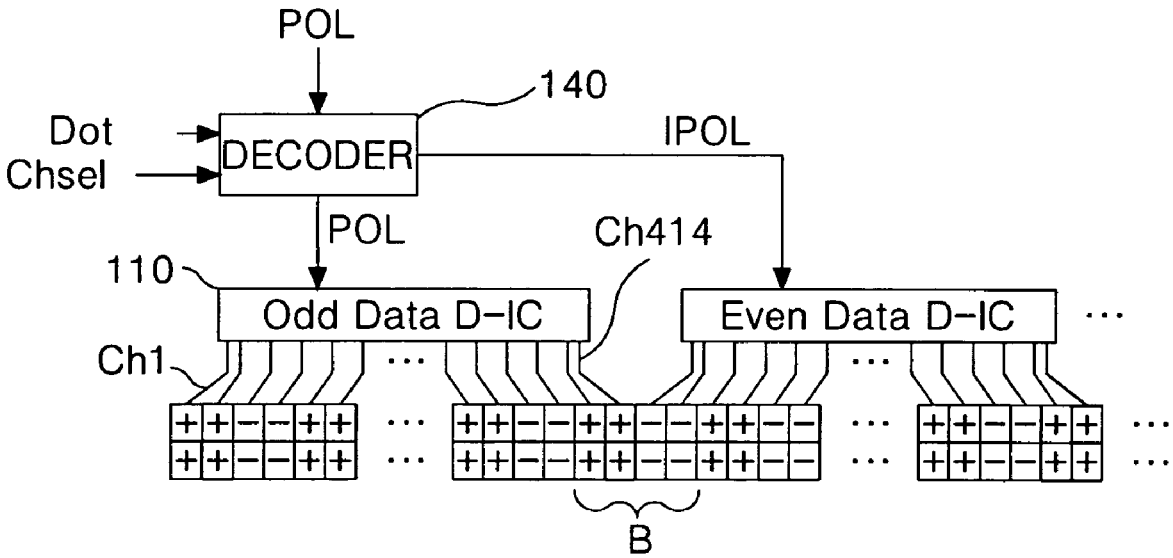
FIG. 12 is a diagram illustrating a polarity pattern of a square inversion system outputted between adjacent D-IC's having a number of output channels that is a multiple of 2, illustrated in FIG. 6.

On the other hand, if the liquid crystal display panel 106 is driven by the square inversion system using the data D-IC 110 having a number of output channels that is a multiple of 2, as illustrated in FIG. 8, the decoder 140 supplies the polarity signal POL supplied from the timing controller 130 to the odd-numbered data D-IC 110 and the inverted polarity signal IPOL, which was made by inverting the polarity signal POL supplied from the timing controller 130, to the even-numbered data D-IC 110. Accordingly, the driving apparatus and method of the liquid crystal display device according to the first embodiment of the present invention has the polarity of the sub-pixel signal inverted, wherein the sub-pixel signal is supplied to the liquid crystal display panel 106 from the bordering area B between the adjacent data D-IC's 110, i.e., each of the last output channel of the odd-numbered data D-IC 110 and the first output channel of the even-numbered data D-IC 110, as illustrated in FIG. 12. In other words, in driving the data D-IC 110 having a number of output channels that is a multiple of 2, by the square inversion system, the inverted polarity signal IPOL outputted from the decoder 140 is supplied to the even-numbered data D-IC 110, thereby inverting the polarity signals POL, IPOL supplied to the odd-numbered data D-IC 110 and the even-numbered data D-IC 110.

Accordingly, the driving apparatus and method of the liquid crystal display device according to the first embodiment of the present invention, in which the liquid crystal display panel 106 is driven by the square inversion system using the data D-IC 110 having a number of output channels that is a multiple of 2 has the repetition period of the polarity pattern of the sub-pixel signal uniform by the square inversion system, wherein the repetition period is in accordance with the number of the output channels of the data D-IC 110, thereby preventing the picture quality defect caused by the non-uniformity of the polarity pattern of the sub-pixel signal.

Figure 13:
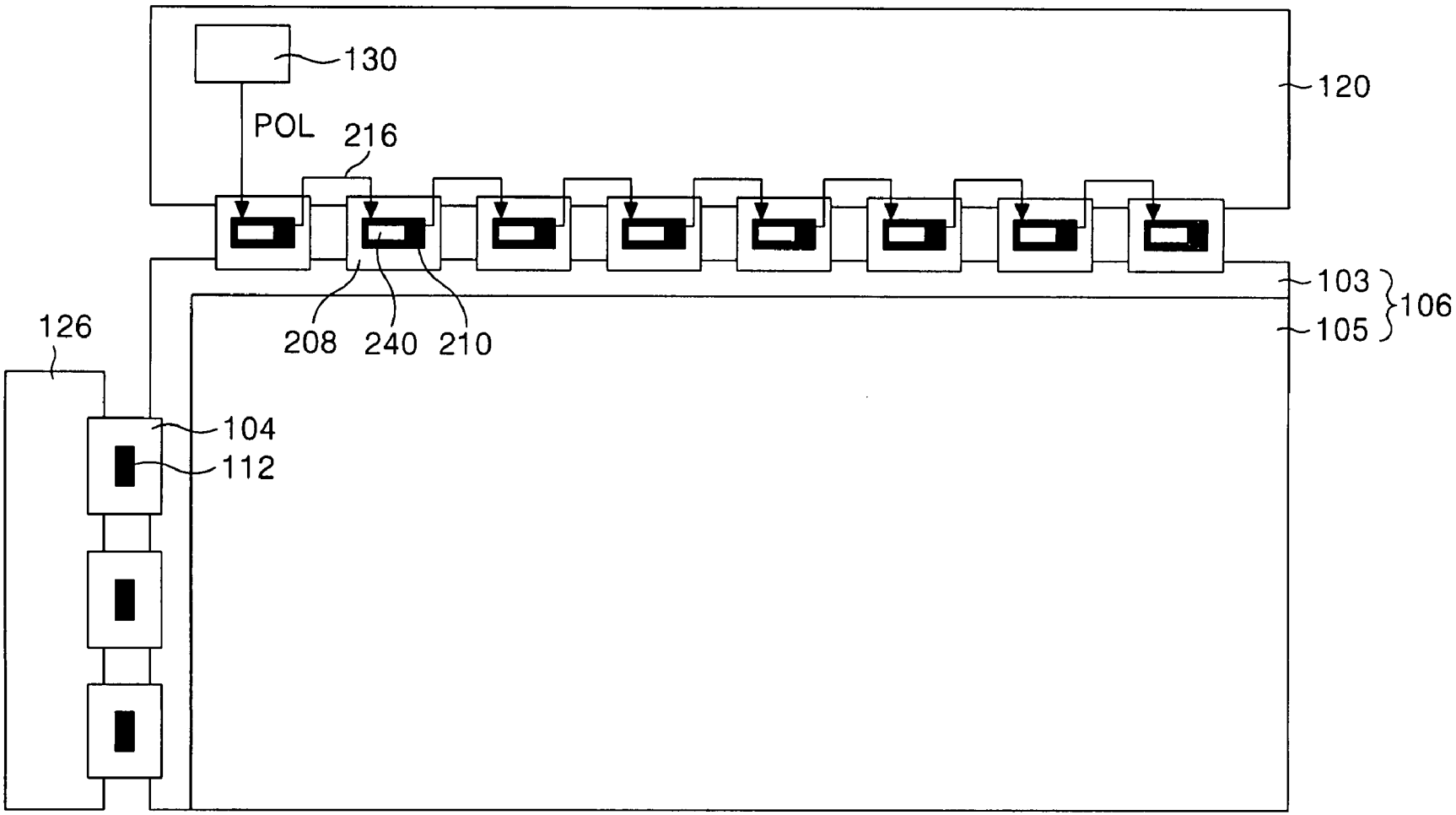
FIG. 13 is a diagram illustrating a driving apparatus of a liquid crystal display device according to a second embodiment of the present invention.

Referring to FIG. 13, a driving apparatus of a liquid crystal display device according to a second embodiment of the present invention has the decoder 240 in the first embodiment of the present invention built-in each of a plurality of data D-IC's 210. Accordingly, in the driving apparatus of the liquid crystal display device according to the second embodiment of the present invention, the explanation for the other composition except for an explanation about the data TCP's 210 on which the data D-IC 210 having the decoder 240 built-in is mounted will be replaced with the explanation for the driving apparatus of the liquid crystal display device according to the first embodiment of the present invention.

The decoder 240 is built in the data D-IC 210. The decoder 240 built-in each of the data D-IC's 210 is connected to each other by a cascade 216 method. The decoder 240 of the first data D-IC 210 mounted on the first data TCP 208 receives the polarity signal POL from the timing controller 130. In addition, the polarity signal POL, the first selection signal Dot of high state or low state in accordance with the inversion method of the liquid crystal display panel 106 through the data PCB 120, and the second selection signal corresponding to the number of output channels of the data D-IC's 210 are inputted to each decoder 240. The decoder 240 built in the first data D-IC 210 inverts the polarity signal POL supplied from the timing controller 130 on the basis of the first and second selection signals Dot, Chsel to supply them to the first data D-IC 210 through the first output terminal and to the second data D-IC 210 through the second output terminal. And, each of the decoders 240 built in the data D-IC's 210 other than the first data D-IC 210 inverts the polarity signal POL inputted from the second output terminal of the decoder 240 built in the previous data D-IC 210 on the basis of the first and second selection signals Dot, Chsel to supply the inverted polarity signal to the data D-IC 210 and to the decoder 240 built in the next data D-IC 210.

The driving apparatus and method of the liquid crystal display device according to the second embodiment of the present invention inverts the polarity signal supplied between the adjacent data D-IC's 210 so as to match the repetition period of the polarity pattern of the sub-pixel signal with the number of output channels of the data D-IC 210 using the decoder 240 built in the data D-IC 210, thereby preventing the picture quality defect in the bordering area between the adjacent data D-IC's 210.

For example, as described in the driving apparatus and method of the liquid crystal display device according to the second embodiment of the present invention, if the liquid crystal display panel 106 is driven by the one-dot inversion system, the repetition period of the polarity pattern of the sub-pixel signal is made to be uniform regardless of the number of output channels of the data D-IC 210 even though the polarity signal POL between the adjacent data D-IC's 210 is not inverted, thereby preventing the picture quality defect caused by the non-uniformity of the polarity pattern of the sub-pixel signal.

Figure 14:
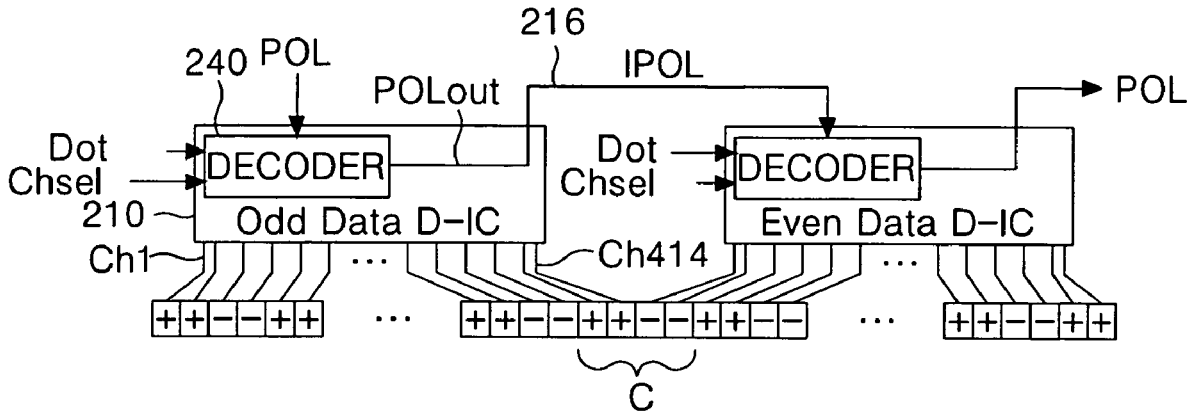
FIG. 14 is a diagram illustrating a polarity pattern of a two-dot inversion system outputted between adjacent D-IC's having a number of output channels that is a multiple of 2, illustrated in FIG. 13.

On the other hand, if the liquid crystal display panel 106 is driven by the horizontal two-dot inversion system using the data D-IC 210 having a number of output channels that is a multiple of 2, as illustrated in FIG. 8, the decoder 240 built in the odd-numbered data D-IC 210 supplies the polarity signal POL of a first logic state to the odd-numbered data D-IC 210 and the polarity signal IPOL of a second logic state, which is made by inverting the polarity signal POL of the first logic state, to the decoder 240 built in the even-numbered data D-IC 210. And the decoder 240 built in the even-numbered data D-IC 210 supplies the polarity signal IPOL of the second logic state inputted from the second output terminal POLout of the decoder 240 built in the odd-numbered data D-IC 210 to the even-numbered data D-IC 210, and supplies the polarity signal POL of the first logic state, which is made by inverting the polarity signal IPOL of the second logic state, to the odd-numbered data D-IC 210. Accordingly, the driving apparatus and method of the liquid crystal display device according to the second embodiment of the present invention has the polarity of the sub-pixel signal inverted, wherein the sub-pixel signal is supplied to the liquid crystal display panel 106 from the bordering area C between the adjacent data D-IC's 210, i.e., each of the last output channel of the odd-numbered data D-IC 210 and the first output channel of the even-numbered data D-IC 210, as illustrated in FIG. 14. In other words, in driving the data D-IC 210 having a number of output channels that is a multiple of 2, by the horizontal two-dot inversion system, the polarity signal IPOL of the second logic state outputted from the decoder 240 built in the odd-numbered data D-IC 210 is supplied to the even-numbered data D-IC 210, thereby inverting the polarity signals POL, IPOL supplied to the odd-numbered data D-IC 210 and the even-numbered data D-IC 210.

Accordingly, the driving apparatus and method of the liquid crystal display device according to the second embodiment of the present invention, in which the liquid crystal display panel 106 is driven by the horizontal two-dot inversion system using the data D-IC 210 having a number of output channels that is a multiple of 2, has the repetition period of the polarity pattern of the sub-pixel signal uniform by the horizontal two dots, wherein the repetition period is in accordance with the number of the output channels of the data D-IC 210, thereby preventing the picture quality defect caused by the non-uniformity of the polarity pattern of the sub-pixel signal.

Figure 15:
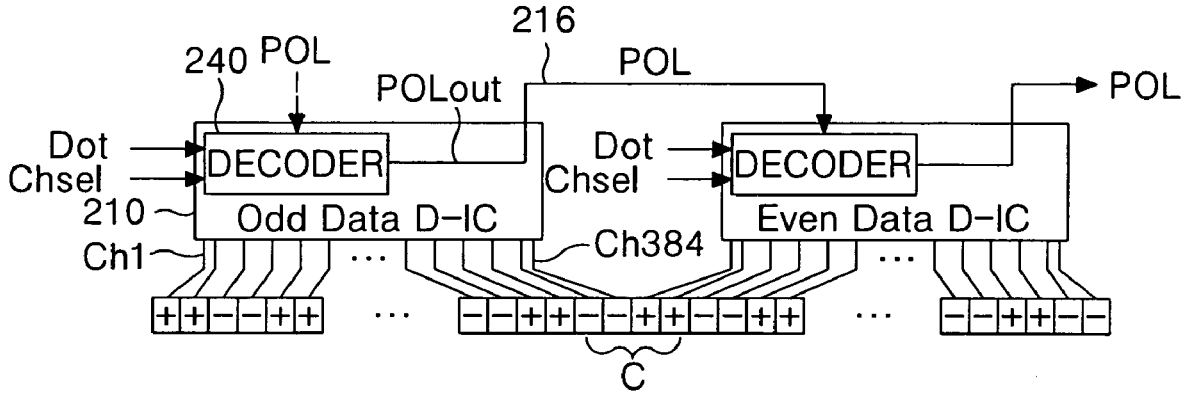
FIG. 15 is a diagram illustrating a polarity pattern of a two-dot inversion system outputted between adjacent D-IC's having a number of output channels that is a multiple of 4, illustrated in FIG. 13.

On the other hand, if the liquid crystal display panel 106 is driven by the horizontal two-dot inversion system using the data D-IC 210 having a number of output channels that is a multiple of 4, as illustrated in FIG. 8, the decoder 240 built in the odd-numbered data D-IC 210 supplies the inputted polarity signal POL of the same logic to the odd-numbered data D-IC 210 and to the even-numbered data D-IC 210. And the decoder 240 built in the even-numbered data D-IC 210 supplies the polarity signal IPOL inputted from the second output terminal POLout of the decoder 240 built in the odd-numbered data D-IC 210 to the even-numbered data D-IC 210, and to the odd-numbered data D-IC 210. Accordingly, the driving apparatus and method of the liquid crystal display device according to the second embodiment of the present invention has the polarity of the sub-pixel signal inverted, wherein the sub-pixel signal is supplied to the liquid crystal display panel 106 from the bordering area C between the adjacent data D-IC's 210, i.e., each of the last output channel of the odd-numbered data D-IC 210 and the first output channel of the even-numbered data D-IC 210, as illustrated in FIG. 15.

Accordingly, the driving apparatus and method of the liquid crystal display device according to the second embodiment of the present invention, in which the liquid crystal display panel 106 is driven by the horizontal two-dot inversion system using the data D-IC 210 having a number of output channels that is a multiple of 4, has the repetition period of the polarity pattern of the sub-pixel signal uniform by the horizontal two dots, wherein the repetition period is in accordance with the number of the output channels of the data D-IC 210, thereby preventing the picture quality defect caused by the non-uniformity of the polarity pattern of the sub-pixel signal.

Figure 16:
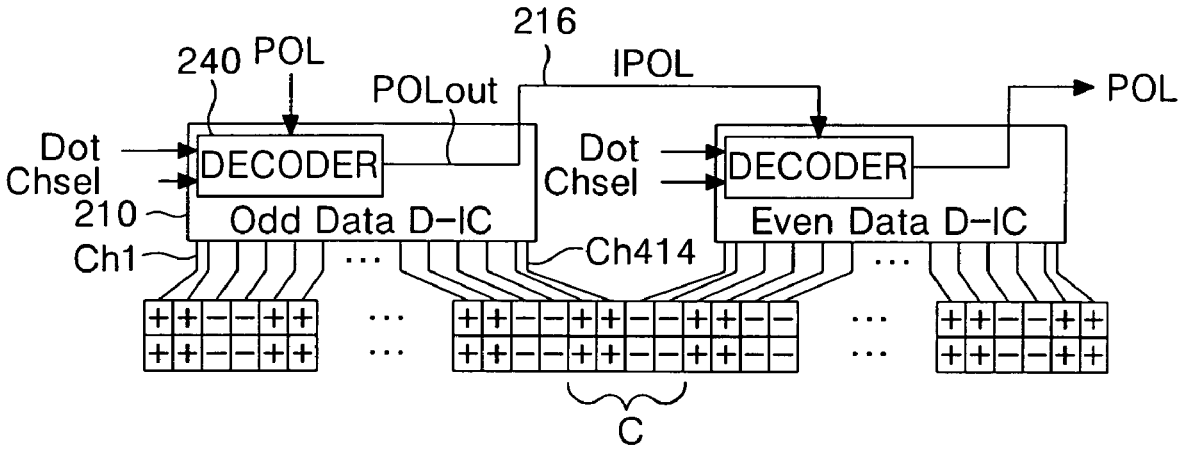
FIG. 16 is a diagram illustrating a polarity pattern of a square inversion system outputted between adjacent D-IC's having a number of output channels that is a multiple of 2, illustrated in FIG. 13.

On the other hand, if the liquid crystal display panel 106 is driven by the square inversion system using the data D-IC 210 having a number of output channels that is a multiple of 2, as illustrated in FIG. 8, the decoder 240 built in the odd-numbered data D-IC 210 supplies the inputted polarity signal POL of a first logic state to the odd-numbered data D-IC 210 and the polarity signal IPOL of a second logic state, which is made by inverting the polarity signal POL of the first logic state, to the even-numbered data D-IC 210. And the decoder 240 built in the even-numbered data D-IC 210 supplies the polarity signal IPOL of the second logic state inputted from the second output terminal POLout of the decoder 240 built in the odd-numbered data D-IC 210 to the even-numbered data D-IC 210, and supplies the polarity signal POL of the first logic state, which is made by inverting the polarity signal IPOL of the second logic state, to the odd-numbered data D-IC 210. Accordingly, the driving apparatus and method of the liquid crystal display device according to the second embodiment of the present invention has the polarity of the sub-pixel signal inverted, wherein the sub-pixel signal is supplied to the liquid crystal display panel 106 from the bordering area C between the adjacent data D-IC's 210, i.e., each of the last output channel of the odd-numbered data D-IC 210 and the first output channel of the even-numbered data D-IC 210, as illustrated in FIG. 16. In other words, in driving the data D-IC 210 having a number of output channels that is a multiple of 2, by the square inversion system, the polarity signal IPOL of the second logic state outputted from the decoder 240 built in the odd-numbered data D-IC 210 is supplied to the even-numbered data D-IC 210, thereby inverting the polarity signals POL, IPOL supplied to the odd-numbered data D-IC 210 and the even-numbered data D-IC 210.

Accordingly, the driving apparatus and method of the liquid crystal display device according to the second embodiment of the present invention, in which the liquid crystal display panel 106 is driven by the square inversion system using the data D-IC 210 having a number of output channels that is a multiple of 2, has the repetition period of the polarity pattern of the sub-pixel signal uniform by the horizontal two dots, wherein the repetition period is in accordance with the number of the output channels of the data D-IC 210, thereby preventing the picture quality defect caused by the non-uniformity of the polarity pattern of the sub-pixel signal.

Figure 17:
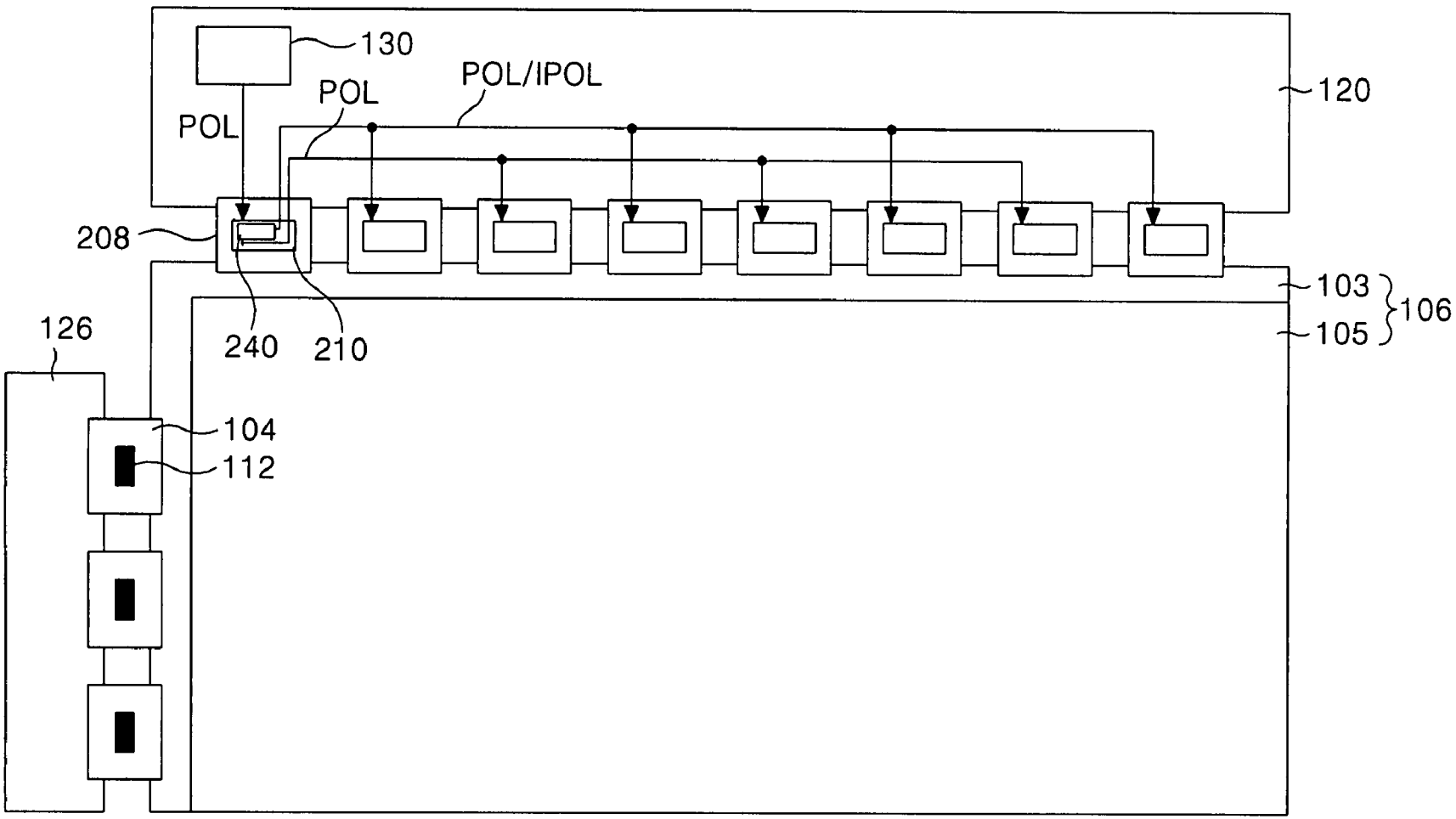
FIG. 17 is a diagram illustrating a driving apparatus of a liquid crystal display device according to a third embodiment of the present invention.

On the other hand, referring to FIG. 17, a driving apparatus of a liquid crystal display device according to a third embodiment of the present invention has components that are mixture of the driving apparatuses of the liquid crystal display devices according to the first and second embodiments of the present invention described as above.

For example, in the driving apparatus of the liquid crystal display according to the third embodiment of the present invention, the decoder 240 is built in any one of a plurality of data D-IC 210. Hereinafter, it will be described assuming that the decoder 240 is built in the first data D-IC 210 among the data D-IC's 210.

Accordingly, the decoder 240 built in the first data D-IC 210 controls the polarity signal POL supplied from the timing controller 130 through the data PCB 120 and the data TCP 208 on the basis of the foregoing first and second selection signals Dot, Chsel to output it to the first and second output terminals. The first output terminal of the decoder 240 built in the first data D-IC 210 is connected to the first signal line formed in the data PCB 120 through the data TCP 208, and the second output terminal is connected to the second signal line formed in the data PCB 120 through the data TCP 208. Herein, the first signal line is connected to each of the odd-numbered data D-IC's 210 and the second signal line is connected to each of the even-numbered data D-IC's 210.

Accordingly, the decoder 240 built in the first data D-IC 210, as described above, supplies the polarity signal POL from the timing controller 130 to the first signal line through the first output terminal in response to the first selection signal Dot of the first logic state and the second selection signal Chsel of the first logic state, and inverts the polarity signal POL to supply it to the second signal line through the second output terminal.

Further, the decoder 240 built in the first data D-IC 210, as described above, supplies the polarity signal POL from the timing controller 130 to the first and second signal lines through each of the first and second output terminals in response to the first and second selection signals Dot, Chsel of a logic state other than the first selection signal Dot of the first logic state and the second selection signal Chsel of the first logic state.

Accordingly, the data D-IC's 210 generate the polarity pattern of the sub-pixel signal of a video signal supplied from the timing controller 130 to supply it to the liquid crystal display panel 106 in response to the polarity signal POL/IPOL supplied from the decoder 240 built in the first data D-IC 210 through the first and second signal lines. The first data D-IC 210 receives the polarity signal POL directly from the first output terminal of the decoder 240.

Accordingly, the driving apparatus and method of the liquid crystal display device according to the third embodiment of the present invention, as described in the first and second embodiments of the present invention has the repetition period of the polarity pattern of the sub-pixel signal uniform by the horizontal two dots or by the square, wherein the repetition period is in accordance with the number of the output channels of the data D-IC 210, thereby preventing the picture quality defect caused by the non-uniformity of the polarity pattern of the sub-pixel signal As described above, the driving apparatus and method of the liquid crystal display device according to the embodiment of the present invention includes the decoder which changes the polarity signal and supplies it to the data D-IC on the basis of the number of output channels of the data D-IC and the polarity pattern of the sub-pixel signal displayed in the liquid crystal display panel. Accordingly, this invention can make the repetition period of the polarity pattern of the sub-pixel signal uniform, wherein the repetition period is in accordance with the number of output channels of the data D-IC. Therefore, this invention can prevent the picture quality defect caused by the non-uniformity of the polarity pattern of the sub-pixel signal generated at the bordering area between the adjacent data D-IC's.

Although the present invention has been explained by the embodiments illustrated in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A driving apparatus of a liquid crystal display device, comprising:

a liquid crystal display panel having a liquid crystal cell of a matrix shape to display a video signal;

N number of data drive circuits that generate a polarity pattern of the video signal and supply it to the liquid crystal cell through a plurality of output channels, wherein each N number of data drive circuit has the plurality of output signals; and a polarity controller that generates second and third polarity signals from a first polarity signal to supply it to the N number of data drive circuits on the basis of a first selection signal corresponding to the number of the output channels and a second selection signal corresponding to a repetition period of the polarity pattern, wherein the second polarity signal is the first polarity signal, and the third polarity signal is inverted or as it is from the first polarity signal, and wherein the polarity patterns of the N number of data drive circuits that the inverted third polarity signal is supplied are inverted in response to the inverted third polarity signal, wherein the polarity controller includes a first input terminal supplied the first polarity signal, a second input terminal to which the first selection signal is inputted in accordance with the inversion method of the liquid crystal display panel, a third input terminal to which the second selection signal corresponding to the number of output channels of the data drive circuits is inputted, a first output terminal to output the second polarity signal and a second output terminal to invert and output the third polarity signal, wherein the first output terminal is connected to each of the odd-numbered data drive circuits, and the second output terminal is connected to each of the even-numbered data drive circuits.

2. The driving apparatus according to claim 1, further comprising:

a timing controller that supplies the video signal to the N number of the data drive circuits and generates the first polarity signal; and a printed circuit board on which the timing controller is mounted.

3. The driving apparatus according to claim 2, wherein the polarity pattern is in accordance with a horizontal two-dot inversion system where said polarity is alternated by the two liquid crystal cells in a horizontal direction of the liquid crystal display panel, and by the one liquid crystal cell in a vertical direction of the liquid crystal display panel.

4. The driving apparatus according to claim 2, wherein the polarity pattern is in accordance with a square inversion system where said polarity is alternated by the two liquid crystal cells in horizontal and vertical directions of the liquid crystal display panel.

5. The driving apparatus according to claim 3 or 4, wherein the second input terminal of the polarity controller receives the first selection signal of a first logic state corresponding to the number of the a number of output channels that is a multiple of 2, the third input terminal of the polarity controller receives the second selection signal of the first logic state corresponding to any one system of the two-dot inversion system and the square inversion system and the first input terminal of the polarity controller receives the first polarity signal.

6. The driving apparatus according to claim 5, wherein the polarity controller outputs first polarity signal from the timing controller as the second polarity signal through the first output terminal and inverts the first polarity signal to generate the third polarity signal and to output it through the second output terminal in response to a first selection signal of the first logic state and a second selection signal of the first logic state.

7. The driving apparatus according to claim 5, wherein the polarity controller outputs the first polarity signal from the timing controller as the second and third polarity signals having the same polarity through each of first and second output terminals in response to each of the first and second selection signals of a logic state other than the first selection signal of the first logic state and the second selection signal of the first logic state.

8. The driving apparatus according to claim 2, wherein the polarity controller is mounted on the printed circuit board.

9. The driving apparatus according to claim 2, wherein the polarity controller is built in any one among the N number of the data drive circuits.

* * * * *